US008096329B2

(12) United States Patent
Thuot et al.

(10) Patent No.: US 8,096,329 B2
(45) Date of Patent: Jan. 17, 2012

(54) HAND-HELD VACUUM PUMP

(75) Inventors: Raechell M. Thuot, Racine, WI (US); Bryan L. Ackerman, Freeland, MI (US); Brian C. Dais, Saginaw, MI (US); Robert R. Turvey, Sanford, MI (US); Jeramy M. Dubay, Hope, MI (US)

(73) Assignee: S. C. Johnson & Son, Inc., Racine, WI (US)

( * ) Notice: Subject to any disclaimer, the term of this patent is extended or adjusted under 35 U.S.C. 154(b) by 1250 days.

(21) Appl. No.: 11/818,703

(22) Filed: Jun. 15, 2007

(65) Prior Publication Data

US 2008/0308177 A1 Dec. 18, 2008

(51) Int. Cl.
*B65B 31/04* (2006.01)

(52) U.S. Cl. ..... 141/65; 141/127; 417/415; 417/521

(58) Field of Classification Search ..... 141/65, 141/67, 127; 417/415, 521; 53/512
See application file for complete search history.

(56) References Cited

U.S. PATENT DOCUMENTS

| | | | | |
|---|---|---|---|---|
| 2,226,145 | A | | 12/1940 | Smith |
| 2,465,554 | A | | 3/1949 | Roy |
| 2,629,539 | A | | 2/1953 | Drewes, Jr. |
| 2,635,550 | A | | 4/1953 | Granberg |
| 2,821,338 | A | | 1/1958 | Metzger |
| 3,149,772 | A | | 9/1964 | Olsson |
| 3,237,844 | A | | 3/1966 | Hughes |
| 3,302,859 | A | | 2/1967 | Perry |
| 3,703,170 | A | | 11/1972 | Ryckman, Jr. |
| 3,762,404 | A | | 10/1973 | Sakita |
| 3,811,432 | A | | 5/1974 | Moret |
| 3,977,084 | A | | 8/1976 | Sloan |
| 4,033,511 | A | | 7/1977 | Chamberlin |
| 4,051,971 | A | | 10/1977 | Saleri et al. |
| 4,072,210 | A | | 2/1978 | Chien |
| 4,080,105 | A | | 3/1978 | Connell |
| 4,085,886 | A | | 4/1978 | Nishioka |
| 4,134,535 | A | | 1/1979 | Barthels et al. |
| 4,310,118 | A | | 1/1982 | Kisida et al. |
| 4,389,166 | A | | 6/1983 | Harvey et al. |
| 4,524,460 | A | | 6/1985 | Twiehoff et al. |
| 4,576,283 | A | | 3/1986 | Fafournoux |
| 4,656,687 | A | | 4/1987 | Wei |
| 4,712,983 | A | | 12/1987 | Moynihan |
| 4,741,789 | A | | 5/1988 | Zieke et al. |
| 4,755,248 | A | | 7/1988 | Geiger et al. |
| 4,832,096 | A | | 5/1989 | Kohlbach |
| 4,927,474 | A | | 5/1990 | Pawloski |
| 4,984,611 | A | * | 1/1991 | Takatsuki et al. ..... 141/65 |
| 5,012,561 | A | | 5/1991 | Porchia et al. |
| 5,195,427 | A | | 3/1993 | Germano |

(Continued)

FOREIGN PATENT DOCUMENTS

DE 1 901 372 U 9/1964

(Continued)

*Primary Examiner* — Timothy L Maust

(57) ABSTRACT

A hand-held vacuum device includes a housing to hold an electrical motor operable to drive a piston pump that is configured to draw a substantially continuous vacuum for each complete cycle of the piston pump. The hand-held vacuum device also includes an expansion chamber releasably connected to and in fluid communication with the housing and a vacuum interface that has a vacuum connector in fluid communication with the expansion chamber and is configured to releasably couple to a valve disposed on a container. The expansion chamber separates air and liquid from a fluid drawn into the expansion chamber.

47 Claims, 15 Drawing Sheets

U.S. PATENT DOCUMENTS 5,203,458 A 4/1993 Cornwell
5,215,445 A * 6/1993 Chen ..... 417/313
5,254,073 A 10/1993 Richison et al.
5,263,777 A 11/1993 Domke
5,287,680 A 2/1994 Lau
5,304,041 A 4/1994 Fontanazzi et al.
5,351,828 A 10/1994 Becker et al.
5,388,910 A 2/1995 Koyanagi
5,450,963 A 9/1995 Carson
5,655,273 A 8/1997 Tomic et al.
5,689,866 A 11/1997 Kasai et al.
5,701,996 A 12/1997 Goto et al.
5,762,480 A * 6/1998 Adahan ..... 417/415
5,765,608 A 6/1998 Kristen
5,784,862 A 7/1998 Germano
5,806,575 A 9/1998 Tsay
5,971,613 A 10/1999 Bell
5,988,426 A 11/1999 Stern
5,989,608 A 11/1999 Mizuno
5,992,442 A 11/1999 Urquhart et al.
5,992,635 A 11/1999 Walters
5,996,800 A 12/1999 Pratt
6,010,244 A 1/2000 Dobreski et al.
6,032,827 A 3/2000 Zettle et al.
6,039,182 A 3/2000 Light
6,045,264 A 4/2000 Miniea
6,056,439 A 5/2000 Graham
6,059,457 A 5/2000 Spreche et al.
6,185,796 B1 2/2001 Ausnit
6,216,314 B1 4/2001 Dangerfield
6,231,236 B1 5/2001 Tilman
6,299,353 B1 10/2001 Piechocki et al.
6,468,332 B2 10/2002 Goglio et al.
6,513,659 B1 2/2003 Ogura et al.
6,520,071 B1 * 2/2003 Lanza ..... 99/472
6,626,092 B2 9/2003 Tarlow
6,637,939 B2 10/2003 Huffer
6,663,284 B2 12/2003 Buckingham et al.
6,763,857 B2 7/2004 Brown
6,770,006 B2 8/2004 Abrahamsen
6,954,969 B1 10/2005 Sprehe
6,955,465 B2 10/2005 Machacek et al.
6,968,870 B1 11/2005 Tsay
6,971,417 B2 12/2005 Deni
6,983,845 B2 1/2006 Shah et al.
7,004,632 B2 2/2006 Hamilton et al.
7,041,249 B2 5/2006 Wright et al.
7,063,231 B2 6/2006 Stanos et al.
7,076,929 B2 7/2006 Patterson et al.
D525,823 S 8/2006 Littmann
7,096,893 B2 8/2006 Vilalta et al.
7,127,875 B2 10/2006 Cheung
7,178,555 B2 2/2007 Engel et al.
7,197,860 B2 4/2007 Hughes et al.
7,197,861 B2 4/2007 Higer et al.
7,200,974 B2 4/2007 Higer et al.
7,204,067 B2 4/2007 Baptista
7,207,160 B2 4/2007 Baptista
7,244,223 B2 7/2007 Hartman et al.
7,246,555 B2 7/2007 Small et al.
D550,717 S 9/2007 Saunders et al.
D550,718 S 9/2007 Saunders et al.
7,272,919 B2 * 9/2007 Cheung ..... 53/510
D552,625 S 10/2007 Saunders et al.
7,284,361 B2 * 10/2007 Lau ..... 53/512
7,290,660 B2 11/2007 Tilman et al.
7,305,742 B2 12/2007 Anderson
7,389,629 B2 * 6/2008 Tretina ..... 53/512
7,410,298 B2 8/2008 Pawloski
7,527,585 B2 5/2009 Anzini et al.
7,726,880 B2 6/2010 Zimmerman et al.
7,784,160 B2 8/2010 Dais et al.
7,837,387 B2 11/2010 Newrones et al.
7,857,515 B2 12/2010 Dais et al.
7,874,731 B2 1/2011 Turvey et al.
7,886,412 B2 2/2011 Dais et al.
7,887,238 B2 2/2011 Turvey et al.
7,937,914 B2 * 5/2011 Savicki et al. ..... 53/510
7,946,766 B2 5/2011 Dais et al.
7,967,509 B2 6/2011 Turvey et al.
2004/0000336 A1 1/2004 Goglio
2004/0000503 A1 1/2004 Shah et al.
2004/0049896 A1 3/2004 Savicki
2004/0112458 A1 6/2004 Brown
2005/0013720 A1 1/2005 Wilk et al.
2005/0022472 A1 2/2005 Brakes et al.
2005/0028493 A1 2/2005 Small et al.
2005/0029152 A1 2/2005 Brakes et al.
2005/0039421 A1 2/2005 Cheung
2005/0081948 A1 4/2005 Deni
2005/0135945 A1 6/2005 Nelson et al.
2005/0175469 A1 8/2005 Lucchi
2005/0286808 A1 12/2005 Zimmerman et al.
2006/0008187 A1 1/2006 Armstrong
2006/0030472 A1 2/2006 Hartman et al.
2006/0048483 A1 3/2006 Tilman et al.
2006/0050999 A1 3/2006 Blythe et al.
2006/0093242 A1 5/2006 Anzini et al.
2006/0110079 A1 5/2006 Zimmerman et al.
2006/0157140 A1 7/2006 Bergman et al.
2006/0182371 A1 8/2006 Borchardt
2006/0193540 A1 8/2006 Borchardt
2006/0213148 A1 9/2006 Baptista
2006/0228057 A1 10/2006 Newrones et al.
2006/0263497 A1 11/2006 Hoffman
2007/0154118 A1 7/2007 Tilman et al.
2007/0155607 A1 7/2007 Bassett et al.
2007/0172157 A1 7/2007 Buchman
2007/0209326 A1 9/2007 Tretina
2007/0232473 A1 10/2007 Hartman et al.

FOREIGN PATENT DOCUMENTS

DE 1 486 280 4/1969
DE 23 31 862 1/1975
DE 24 54 248 5/1976
DE 28 48 835 5/1980
DE 33 12 887 10/1984
DE 34 11 371 10/1985
DE 35 21 373 12/1986
DE 43 05 065 8/1994
DE 198 43 430 2/2000
EP 144 011 6/1985
EP 149 695 7/1985
EP 373 833 6/1990
EP 729 901 9/1996
FR 2 380 953 2/1978
FR 2 695 108 3/1994
JP 63-117180 5/1988
JP 4-60847 5/1992
WO WO 00/71422 11/2000
WO WO 2004/108556 12/2004
WO WO 2004/108557 12/2004
WO WO 2005/000706 1/2005

* cited by examiner

HAND-HELD VACUUM PUMP

CROSS REFERENCE TO RELATED APPLICATION

Not applicable.

REFERENCE REGARDING FEDERALLY SPONSORED RESEARCH OR DEVELOPMENT

Not applicable.

SEQUENTIAL LISTING

Not applicable.

FIELD OF THE INVENTION

The present invention generally relates to hand-held vacuum devices, more particularly, to hand-held vacuum devices for use in evacuating fluid from plastic storage pouches.

BACKGROUND OF THE INVENTION

Vacuum packaging serves a myriad of purposes ranging from prolonging food storage to efficiently using storage space. Numerous vacuum devices are known including vacuum pump devices with various drive mechanisms. It is also known to use vacuum devices in conjunction with food storage containers, and the like, to make vacuum systems.

One vacuum device has a casing containing an electrical motor that drives a cylinder piston-unit forming part of a suction pump. The motor is interconnected with the cylinder piston-unit via a reducer group including a pinion, a crown gear, and an eccentric seat that actuates a connecting rod attached to the piston.

A hand-held suction device has a pump for drawing a vacuum and a motor for driving the pump. The device further has a vacuum sensor.

Another hand-held suction pump for creating a vacuum in a container has a suction valve, an elongated outer casing, an electrical motor, and a piston pump. The pump chamber of the piston pump is connected by an inlet valve and a suction duct to a hollow tip for coupling the suction valve of the container and an exhaust duct. The exhaust duct has a duct opening in the case for porting exhaust from the pump chamber. A baffle covers the exhaust duct.

Yet another suction device has a device for removing and storing excess grease from cooking utensils. The device has a vacuum assembly held within a hollow housing with an elongated nozzle. A port sealable with a removable cap provides an access for removal of grease held within an internal reservoir of the device.

An other hand-held portable apparatus for evacuating storage pouches has a case, a motor, a fan, and a flange operatively arranged to be coupled with a one-way valve on a storage pouch. Rechargeable batteries power the motor.

A container evacuation system has a storage food container and a vacuum pump. The container has a housing and a cover with a first non-return valve. The container evaluation pump can be driven by an electrical drive unit.

A vacuum packaging machine has a housing body, a top cover, a thermal sealing means, a base, and a vacuum generating means. The vacuum pressure generating means has a drive motor, a crank shaft, and a piston.

A storage system has a disposable vacuum pouch with a vacuum valve assembly. A portable vacuum pump assembly is structured to engage the vacuum valve assembly, and a liquid separator assembly is coupled to the portable vacuum pump assembly.

A combination car cleaner and air pump has a motor and a transmission consisting of a worm-gear rod, a worm-gear wheel, and a crank. The motor and transmissions are connected to a piston and a cylinder that draw a vacuum through a hose.

A vacuum extractor mounted in a one-way valve lid of a vacuum container has a motor, a worm, and a worm gear transmission mechanism. The worm gear has an eccentric seat and a rod at the eccentric seat to which is pivoted the link that drives a piston within a cylindrical casing. A head of the cylindrical casing is fastened to the outer side of a one-way valve mounted in a hole in the lid.

Another storage system has a disposable vacuum pouch with a vacuum valve assembly, a portable vacuum pump assembly structure to engage the vacuum valve assembly, and a liquid separator assembly coupled to the portable vacuum pump assembly.

A vacuum pump has a suction side and a vacuum conduit in fluid communication with the vacuum pump suction side. The vacuum conduit has a gas/liquid separator means.

One drive mechanism has a central operating shaft to which a pinion is secured. The pinion meshes simultaneously with a lower longitudinal toothed edge of a first rack plate and an upper longitudinal toothed edge of a second rack plate. Rotation of the pinion causes the first rack plate and the second rack plate to reciprocate in opposite directions.

Another drive mechanism has a pinion fixed upon a shaft and a driven element with an oval rack gear with a wall having an outer contour and a series of teeth that cooperate with the pinion. The pinion moves around and follows the contour of the wall, giving the driven member a vertically reciprocating movement.

Yet another drive mechanism has a spur gear engaging a sliding gear with internal teeth arranged in an oval. The sliding gear is slidable within a yoke via anti-friction rollers that contact opposite ends of the yoke. Guide rollers simultaneously traverse endless guide-ways causing the sliding gear to always remain in mesh with the teeth of the spur gear.

An additional drive mechanism has a carriage slidably mounted on rods and a triangular rack gear. A pinion fixed on a first shaft connected to a second shaft via a universal joint engages teeth of the rack gear. Rotary motion of the pinion causes the carriage to be reciprocated, and the stroke finishes when reciprocatory movement ceases while the pinion moves along the base of the triangle.

Still another drive mechanism has a geared rod with a base plate, upon which are a central lug and a table that form a loop-shaped groove with a rack. A pinion secured to a shaft meshes with the rack. Rotation of the pinion causes the base plate to move in an orbit.

A further drive mechanism has a drive shaft with a pinion that drives a driven element having an oval rack gear. As the pinion turns, the driven element is moved in a reciprocatory manner until the pinion reaches a curved portion of the driven element where the driven element is rocked and the direction of movement reversed.

A piston pump has a piston disposed within a cylinder and an oval rack gear pivotally mounted to the piston. A drive gear mounted on a drive shaft is internally adjacent to the teeth of the oval rack gear. Opposite to the piston, the oval rack gear has a runner that guides the oval rack gear to cooperatively engage the drive gear.

A dosing pump unit has a pump unit with a first chamber and a second chamber, and a first reciprocating piston and a second reciprocating piston movable in the respective first and second chambers, wherein the first and second chambers alternately communicate with inlet and outlet passages. In operation, the inlet passage is opened such that, while the first piston is displaced through a final portion of a first piston suction stroke and while the second piston is displaced through an initial portion of the second piston suction stroke, the inlet passage is fully open to both the first and second chambers.

Another drive mechanism has an actuator with an electrical motor and a transmission that drives an activation element, such as a rotatable arm or a longitudinally movable rod. The actuator has a transmission having a first stage that has a worm gear that drive a first worm wheel.

A two-stage reciprocating positive displacement compressor unit has cooling means that has at least one first rotary ventilation part driven by a rotary shaft for generating a cooling air flow.

SUMMARY OF THE INVENTION

In one aspect, a hand-held vacuum device for evacuating a container includes a housing to hold an electrical motor operable to drive a piston pump and a piston valve. The piston pump and the piston valve are configured to draw a substantially continuous vacuum during each complete cycle of the piston pump. The vacuum device further includes an expansion chamber releasably connected to and in fluid communication with the housing and the piston pump. The expansion chamber includes a deflector to alter a fluid pathway of a fluid before entering an interior volume of the expansion chamber. The vacuum device further includes a vacuum interface having a vacuum connector in fluid communication with the expansion chamber and configured to releasably couple to a valve disposed on a container, to form an airtight seal therewith. The expansion chamber separates air and liquid from the fluid drawn into the interior volume of the expansion chamber and collects the liquid therein.

In another aspect, a vacuum system includes a hand-held vacuum device having a housing including a piston pump that includes a first cylinder having a first piston and a first check-valve and a second cylinder having a second piston and a second check-valve. The housing further includes an electrical motor operatively connected to the worm gear wheel and the first piston, and a second piston shaft eccentrically connected to the worm gear wheel and the second piston. The hand-held vacuum device further includes an expansion chamber having an internal reservoir and a vacuum connector capable of forming a vacuum seal with a pouch valve. The expansion chamber is releasably secured to the housing to enable access to the reservoir, and prevents fouling of the piston pump when a vacuum is drawn through the vacuum interface. The vacuum system further includes a container having a valve disposed thereon to provide fluid communication with the hand-held vacuum device.

In a further aspect, a vacuum system includes a hand-held vacuum device having a housing including a piston pump that includes a cylinder having a piston, an electrical motor with a drive shaft with a worm gear attached thereon and in cooperative engagement with a worm gear wheel, a piston shaft eccentrically connected to the worm gear wheel, and a plurality of one-way valves associated with a proximal end and a distal end of the cylinder, to allow a vacuum to be drawn substantially continuously by the dual action pump as the piston is reciprocated from the distal end and from the proximal end. The hand-held vacuum device further includes an expansion chamber having an internal reservoir and a vacuum connector capable of forming a vacuum seal with a pouch valve. The expansion chamber is releasably secured to the housing to enable access to the reservoir, and prevents fouling of the piston pump when a vacuum is drawn through the vacuum interface. The vacuum system further includes a container having a valve disposed thereon to provide fluid communication with the hand-held vacuum device.

BRIEF DESCRIPTION OF THE DRAWINGS

Other aspects and advantages of the present disclosure will become apparent upon consideration of the following detailed description, wherein similar structures have similar reference numbers.

DETAILED DESCRIPTION

The present disclosure is directed to apparatuses, such as vacuum pumps, that create a vacuum to evacuate a void volume and/or to remove a fluid or a material from a container. Illustrative vacuum pumps include, for example, pumps with a single piston or a plurality of pistons, such as, for example, two pistons that are configured to enable a substantially continuous vacuum to be drawn for each complete cycle of the piston pump. A container may include, for example, a sealable plastic container, a storage pouch with a valve, a can, a bottle, a hermetically sealable volume, a container with a removable lid with a valve associated therewith, and the like, and/or other containers suitable for vacuum packaging. It is further contemplated that the vacuum device may be configured to hinder and/or to prevent the fluid or material removed from the container entering and fouling the vacuum pump. While several specific embodiments are discussed herein, it is understood that the present disclosure is to be considered only as an exemplification of the principles of the invention. The present disclosure is not intended to limit the disclosure to the embodiments illustrated.

Figure 1:
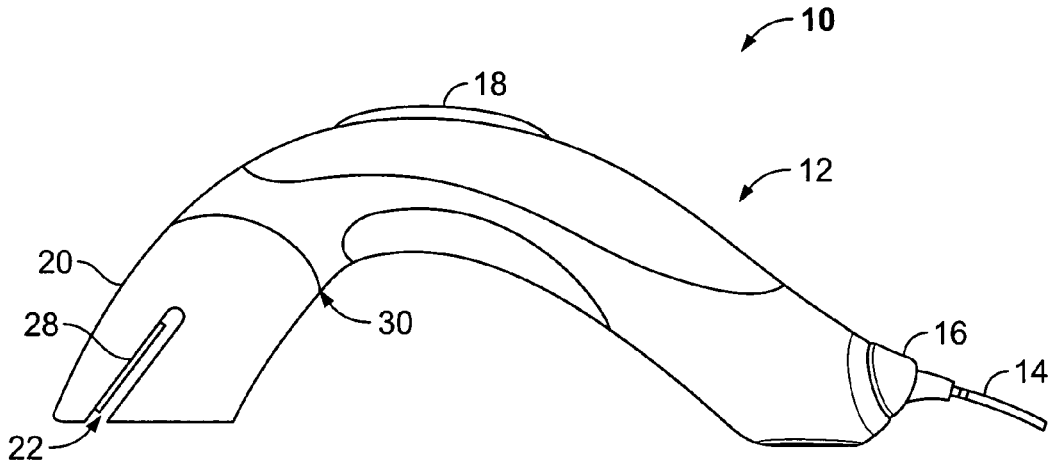
FIG. 1 is a side elevational view of a vacuum device according to one embodiment.

Turning now to the figures, one example of a vacuum device 10 is seen in FIG. 1. The vacuum device 10 includes a housing 12 that holds a vacuum source (not shown), such as a piston pump, though a fan and/or an impeller may be used in lieu of or in addition to the piston pump, that is driven by an electric motor (not shown), and an expansion chamber 20 in fluid communication with the housing. Electrical motors useful in the present disclosure include those disclosed in, for example, Germano U.S. Pat. No. 5,195,427. Other types of motors useful in the present disclosure include AC motors, DC motors including shunt-wound, series wound, compound wound, and the like, brushless motors, servo motors, brushed DC servo motors, brushless AC servo motors, stepper motors, linear motors, and other motors known in the art, all of which are commercially available. The vacuum device 10 includes an electrical cord 14 attached to the housing 12 via swivel connection 16 to power the vacuum source. The vacuum device 10 further includes a user-activated switch 18 for activation of the vacuum source. Switches contemplated for use herein include, for example, a momentary switch, a timer switch that activates the vacuum device 10 for a predetermined amount of time, an attachment-activated switch that is activated upon engagement of the vacuum device with a container (not shown), and/or other user-activated switches known to those skilled in the art, and combinations thereof. A vacuum seal 30 may be positioned between the expansion chamber 20 and the housing 12 to provide airtight communication between the vacuum source and a vacuum interface 22 on the expansion chamber. The housing 12, expansion chamber 20, and any other component of the vacuum device 10 may be made of vacuum resilient and wear and/or use resistant materials, including, for example, a plastic, a metal, a rubber, a composite material, and/or other materials known to one skilled in the art, as well as combinations thereof. One or more components of the vacuum device 10 may also be made of materials that allow the one or more components to be submerged in water during cleaning thereof.

Figure 2:
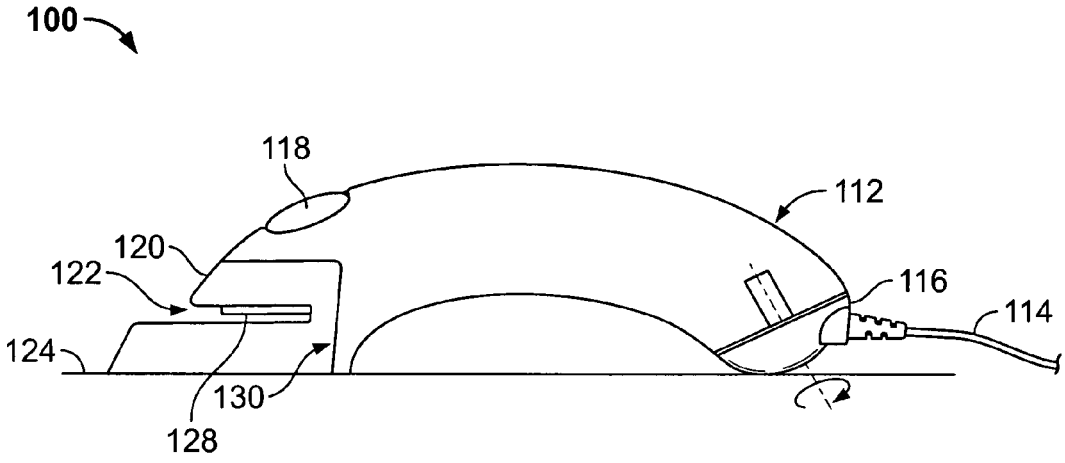
FIG. 2 is a side elevational view of a vacuum device according to another embodiment that can be used on a flat surface.
Figure 3:
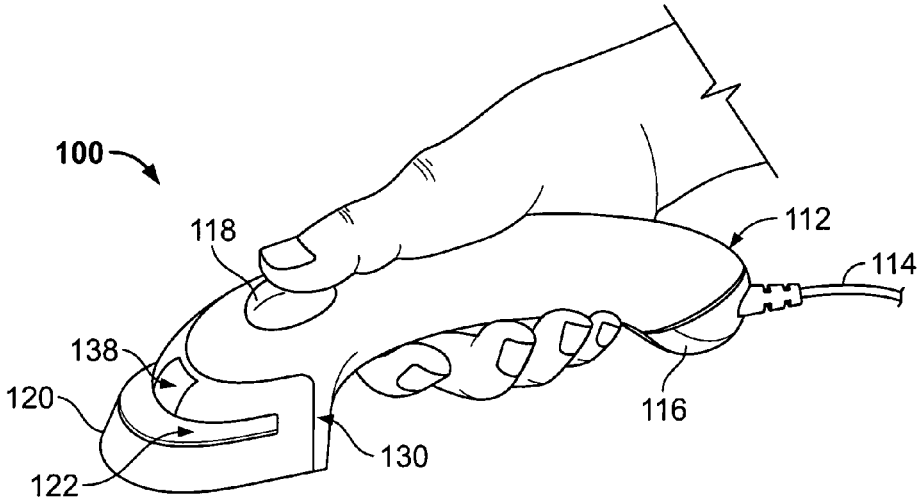
FIG. 3 is a trimetric view of the vacuum device of FIG. 2 used in a hand-held mode.
Figure 4:
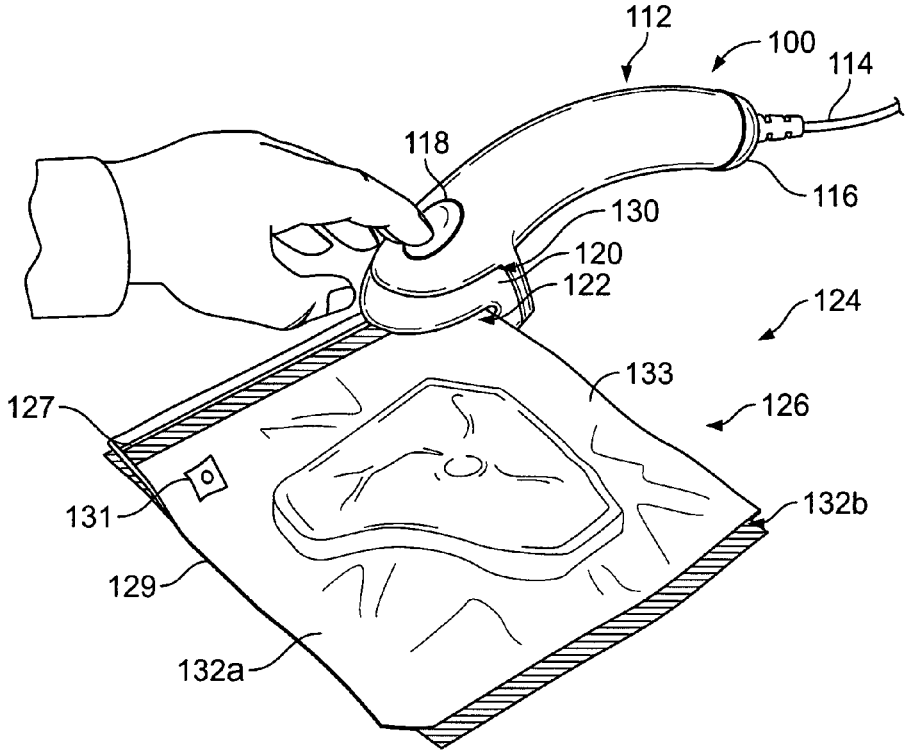
FIG. 4 is a trimetric view of the vacuum device of FIG. 2 used in a hands-free mode.

The configurations of the external elements of the vacuum device 10, including, for example, the housing 12 and the expansion chamber 20, may complement each other to enable the vacuum device to be used in a hand-held mode, as well as a hands-free mode. For example, a table top and/or surface-mounted vacuum device 100 is depicted in FIGS. 2-4. When used as a surface-mounted unit, the vacuum device 10, 100 may be attached to a work surface by any means known to one skilled in the art including, for example, by an adhesive, a polyolefin plastomer, or one or more suction cups. Further, and as explained more fully below, the vacuum device 10, 100 may be configured to insert a portion of a container 126 therein to assist a user, for example, to align the vacuum device with the container.

As seen in FIG. 4, a container, such as a storage pouch 126 having a valve 131, may also include an airtight closure mechanism 127 across a mouth of the storage pouch. When occluded, the closure mechanism may provide an airtight seal, such that a vacuum may be maintained in the pouch interior for a desired period of time, such as days, months, or years, when the closure mechanism is sealed fully across the mouth. The closure mechanism 127 may comprise first and second interlocking closure elements that each may include one or more interlocking closure profiles (not shown). Further, a sealing material, such as a polyolefin material or a caulking composition, such as a silicone grease, may be disposed on or in the closure elements and closure profiles to fill in any gaps or spaces therein when occluded. The ends of the closure elements and closure profiles may also be welded or sealed by ultrasonic vibrations as is known in the art. Illustrative closure profiles, closure elements, sealing materials, and/or end seals useful in the present invention include those disclosed in Pawloski U.S. Pat. No. 4,927,474, Tomic et al. U.S. Pat. No. 5,655,273, Sprehe U.S. Pat. No. 6,954,969, Kasai et al. U.S. Pat. No. 5,689,866, Ausnit U.S. Pat. No. 6,185,796, Wright et al. U.S. Pat. No. 7,041,249, Anderson U.S. Patent Application Publication No. 2004/0091179, now U.S. Pat. No. 7,305,742, Pawloski U.S. Patent Application Publication No. 2004/0234172, now U.S. Pat. No. 7,410,298, Tilman et al. U.S. Patent Application Publication No. 2006/0048483, now U.S. Pat. No. 7,290,660, Anzini et al. U.S. Patent Application Publication No. 2006/0093242, or Anzini et al. U.S. Patent Application Publication No. 2006/0111226, now U.S. Pat. No. 7,527,585. Other closure profiles and closure elements useful in the present invention include those disclosed in, for example, U.S. patent application Ser. No. 11/725,120, filed Mar. 16, 2007, now U.S. Pat. No. 7,886,412, U.S. Pat. No. 7,857,515, U.S. Pat. No. 7,784,160, and U.S. Pat. No. 7,946,466, each filed on the same day as the present application. It is further appreciated that the closure profiles or closure elements disclosed herein may be operated by hand, or a slider may be used to assist in occluding and de-occluding the closure profiles and closure elements.

The sidewalls 132*a*, 132*b* of the container, and/or the closure mechanism 127 may be formed from thermoplastic resins by known extrusion methods. For example, the sidewalls 132*a*, 132*b* may be independently extruded of a thermoplastic material as a single continuous or multi-ply web, and the closure mechanism 127 may be extruded of the same or different thermoplastic material(s) separately as continuous lengths or strands. Illustrative thermoplastic materials include polypropylene (PP), polyethylene (PE), metallocene-polyethylene (mPE), low density polyethylene (LDPE), linear low density polyethylene (LLDPE), ultra low density polyethylene (ULDPE), biaxially-oriented polyethylene terephthalate (BPET), high density polyethylene (HDPE), polyethylene terephthalate (PET), among other polyolefin plastomers and combinations and blends thereof. Further, the inner surfaces of the respective sidewalls 132*a*, 132*b* or a portion or area thereof may, for example, be composed of a polyolefin plastomer such as an AFFINITY™ resin manufactured by Dow Plastics. Such portions or areas include, for example, the area of one or both of the sidewalls 132*a*, 132*b* proximate to and parallel to the closure mechanism 127, to provide an additional cohesive seal between the sidewalls when the pouch 126 is evacuated of fluid. The sidewalls 132*a*, 132*b* may also be formed of air-impermeable film, such as an ethylene-vinyl alcohol copolymer (EVOH) ply adhesively secured between PP and LDPE plies to provide a multilayer film. Other additives, such as colorants, slip agents, and anti-oxidants, including, for example, talc, oleamide or hydroxyl hydrocinnamate may also be added as desired. The closure mechanism 127 may also be extruded primarily of molten PE with various amounts of slip component, colorant, and talc additives in a separate process. The fully formed closure mechanism 127 may be attached to the pouch body 133 using a strip of molten thermoplastic weld material, or by an adhesive known by those skilled in the art, for example. Other thermoplastic resins and air-impermeable films useful in the present invention include those disclosed in, for example, Tilman et al. U.S. Patent Application Publication No. 2006/0048483, now U.S. Pat. No. 7,290,660.

The containers and resealable pouch described herein can be made by various techniques known to those skilled in the art, including those described in, for example, Geiger et al. U.S. Pat. No. 4,755,248. Other useful techniques to make a resealable pouch include those described in, for example, Zieke et al. U.S. Pat. No. 4,741,789. Additional techniques to make a resealable pouch include those described in, for example, Porchia et al. U.S. Pat. No. 5,012,561. Still other techniques to make a container include those described in, for example, Zettle et al. U.S. Pat. No. 6,032,827 and Stanos et al. U.S. Pat. No. 7,063,231. Additional examples of making a resealable pouch as described herein include, for example, a cast post applied process, a cast integral process, and/or a blown process.

Figure 5:
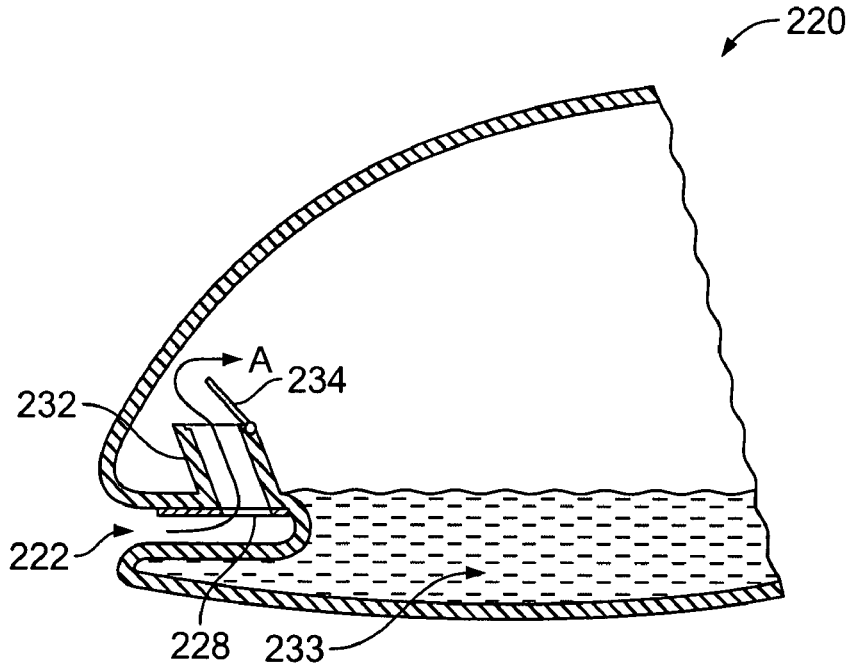
FIG. 5 is a cross-sectional view of an expansion chamber according to one embodiment.
Figure 6:
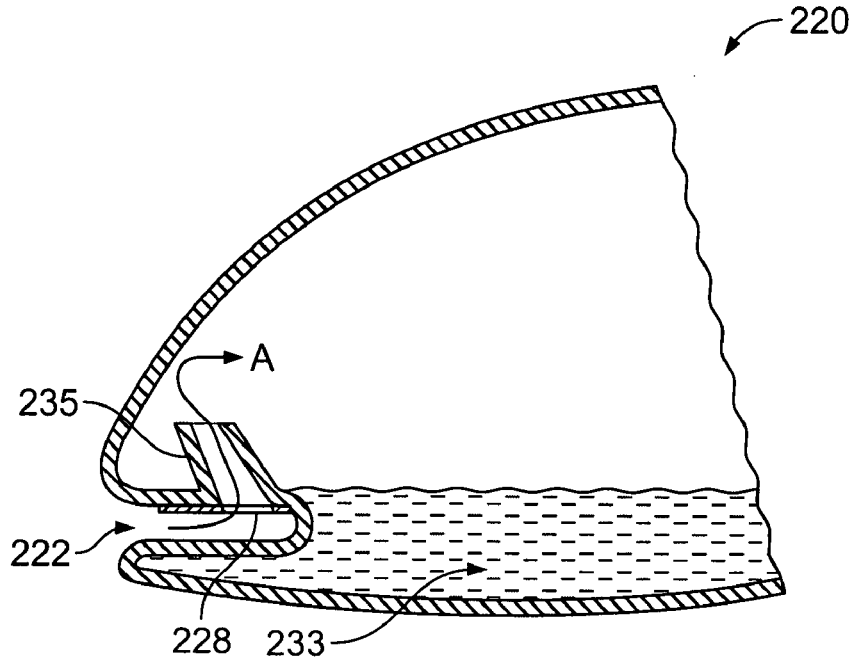
FIG. 6 is a cross-sectional view of an expansion chamber according to another embodiment.
Figure 7:
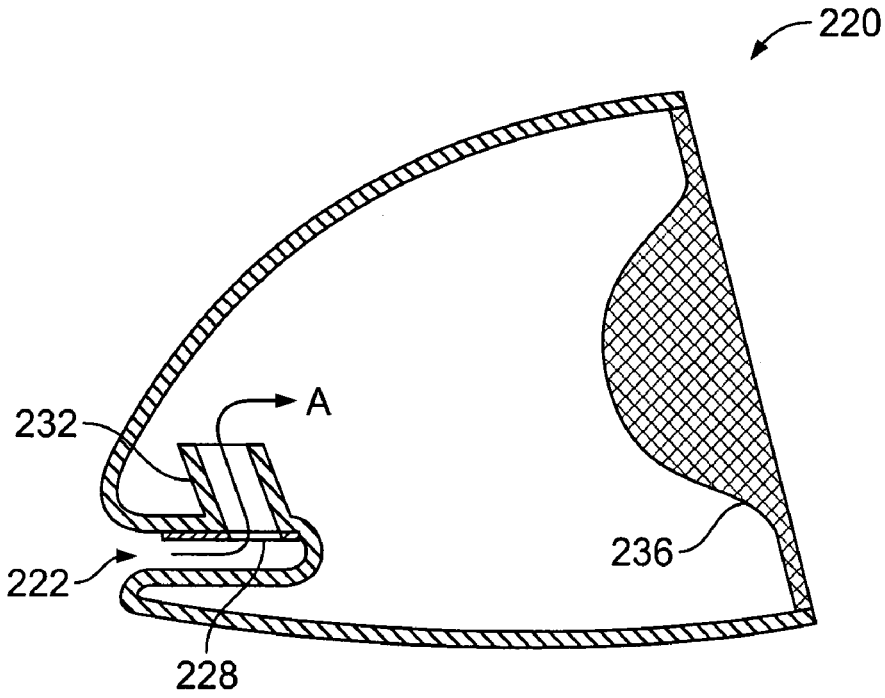
FIG. 7 is a cross-sectional view of an expansion chamber according to a further embodiment.

As shown in FIGS. 5-7, the expansion chamber 220 may be designed to separate liquids and gases from fluid that enters the expansion chamber to reduce or to prevent fouling of the vacuum source (not shown) and to prolong the useful lifetime of the vacuum device 10, 100. The expansion chamber 220 also may help to maintain a clean surface area where the user is applying a vacuum to the container (not shown) by collecting a material, for example, a liquid, within the expansion chamber. Further, once the liquid has entered the expansion chamber 220, the liquid may be prevented from exiting the expansion chamber until a user desires to empty the expansion chamber. For example, and now referred to FIG. 5, the expansion chamber 220 may separate a liquid from a gas, for example, by altering a fluid pathway (arrow A) of a vacuum stream taken in through the vacuum interface 222 by way of a deflector 232, such as an angled tube. The angle of the deflector 232 may be, for example, about 10° or greater from horizontal, or about 20° or greater from horizontal, or about 30° or greater from horizontal, or about 45° or greater from horizontal, or about 60° or greater from horizontal, or about 90° or greater from horizontal, or about 90° or lesser from horizontal, or about 120° or lesser from horizontal, or greater or lesser angles. Not to be bound by theory, it is believed that by altering the angle in this way, the fluid entering the expansion chamber 220 is forced through a tortuous path that slows the velocity of the liquid in the fluid, thus causing the liquid to fall out of the fluid and to be collected in the expansion chamber. Further, the deflector 232 may divert the direction of the fluid stream against the wall of the expansion chamber 220 to cause the liquid in the fluid to adhere to the wall and thus, to fall into the expansion chamber. In addition, the deflector 232 may help to inhibit or to prevent leakage of a material 233, such as a liquid, a solid, or a semi-solid, captured within the expansion chamber 220 through the vacuum interface 222. In addition, a check valve 234 may be included on or in the deflector 232, for example, on an end thereof, that prevents leakage of liquid through the vacuum interface 222. The check valve 234 may be any type of valve that can open in response to a pressure drop, to provide the fluid pathway (arrow A) upon the activation of the vacuum device 10, 100 and closes upon deactivation of the vacuum device. Illustrative check valves 234 include, for example, a spring-loaded flapper valve, and/or any other appropriate valve known in the art.

Further, the expansion chamber 20, 120, 220 may be made of opaque and/or translucent materials and/or may include a transparent window 138, as seen in FIG. 3, through which a user may monitor a level and/or an amount of material, such as a liquid, held within the expansion chamber. It is further contemplated that the expansion chamber 20, 120, 220 may be graduated to enable a user to determine a volume of material held within the expansion chamber. In this way, the user may be able to determine when the expansion chamber 20, 120, 220 should be emptied to maintain proper function of the vacuum device 10, 100. It is further contemplated that the entire expansion chamber 20, 120, 220 be made from a transparent material to enable monitoring of the level and/or amount of material held therewithin. Further, the vacuum device 10, 100 may include one or more sensors to monitor the vacuum level and/or the level of fluid in the expansion chamber 20, 120, 220 that may deactivate the electrical motor, to prevent overheating of the electrical motor and/or overfilling of the expansion chamber. Further, the one or more sensor may enable the level of vacuum being applied to be varied as may be desired for specific uses, such as for different container types and/or different food types held within a container. In this way, operation of the vacuum device 10, 100 may be more efficient, and the lifetime of the vacuum device may be extended. One vacuum sensor that may be useful in the present disclosure is disclosed in, for example, Kristen U.S. Pat. No. 5,765,608. Other suitable vacuum sensors include those known in the art.

In another embodiment, seen in FIG. 6, liquids 233 may be separated from a fluid by hindering or slowing the fluid stream, for example, by using a deflector 235 that has an inner diameter that narrows in the direction of the fluid pathway (arrow A), such as a narrowing tube, separately from or in addition to altering the direction of the vacuum path.

As shown in FIG. 7, an embodiment of the expansion chamber 220 includes a removable mesh screen 236 for the separation of liquids and solids that may be placed in the vacuum path upstream of a vacuum pump (not shown). Suitable mesh screens 236 contemplated for use herein may include, for example, a mesh strainer similar to those used to prevent debris from clogging a sink drain. The mesh screen 236 may be made of any material, such as, for example, stainless steel, plastic, rubber, paper, fabric, and the like, and combinations thereof. It is further contemplated that the mesh screen 236 may be removed from the expansion chamber 220 for cleaning and/or replacing. Alternatively, the entire expansion chamber 220, including the mesh screen 236, may be immersed in water for cleaning and/or washed in a dishwasher.

The embodiments shown in FIGS. 1-9 include an expansion chamber 20, 120, 220, 320 that has the vacuum interface 22, 122, 222, 322 with a slotted configuration. The slotted configuration of the vacuum interface 22, 122, 222, 322 may vary by angle or any other desired characteristic, as is seen, for example, in FIG. 1, compared to FIGS. 2-4, to fit, for example, various shaped containers and/or valves. As seen in FIGS. 2-4, the vacuum interface 122 may be configured to enable a user to place the vacuum device 100 on a flat surface 124 to accept a container 126 from which a material, such as a fluid or solid, is to be evacuated.

Further, the slotted configuration of the vacuum interface 22, 122, 222, 322 may enable, for example, the vacuum device 10, 100, 300 to accept a portion of the container 126 into the vacuum interface as shown in FIG. 4, such as, for example, a valve 131 disposed near an edge 129 of the container, which establishes fluid communication between an interior of the container and the vacuum device. Illustratively, the valve 131 may be a check valve or a one-way valve, to allow air to be evacuated from the container 126 and to maintain a vacuum when the closure mechanism 127, as previously described herein, has been sealed. Illustrated valves useful in the present invention include those disclosed in, for example, Newrones et al. U.S. Patent Application Publication No. 2006/0228057, now U.S. Pat. No. 7,837,387. Other valves useful in the present invention include those disclosed in, for example, U.S. Pat. No. 7,967,509, U.S. Pat. No. 7,946,766, and U.S. Pat. No. 7,874,731, each filed on the same day as the present application. Any configurations of vacuum interface 22, 122, 222, 322 and vacuum connector 28, 128, 228, 328 are contemplated herein to allow a vacuum connection with the container.

As shown in FIG. 4, the container 126 may be a collapsible container, for example, a plastic pouch, that has a valve 131 on a wall thereof. It is further contemplated that a suitable container may include rigid walls and a flexible and/or elastic component that collapses as a fluid is drawn from the container, while the rigid walls maintain their shape. It is further contemplated that the vacuum interface 22, 122, 222, 322 may be so configured to draw a vacuum from the container 126 having more than one valve 131 and/or aperture (not shown).

Figure 8:
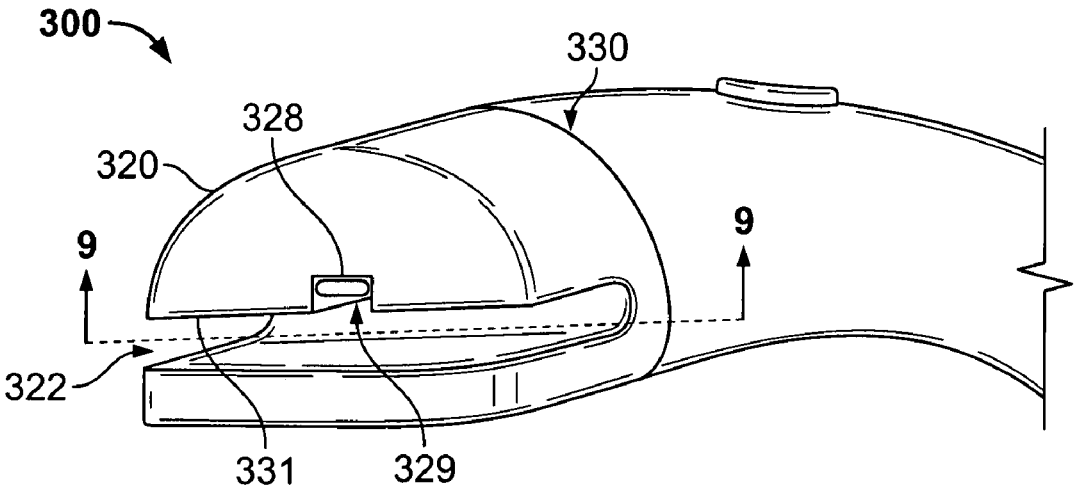
FIG. 8 is a trimetric view of a vacuum device according to one embodiment.
Figure 9:
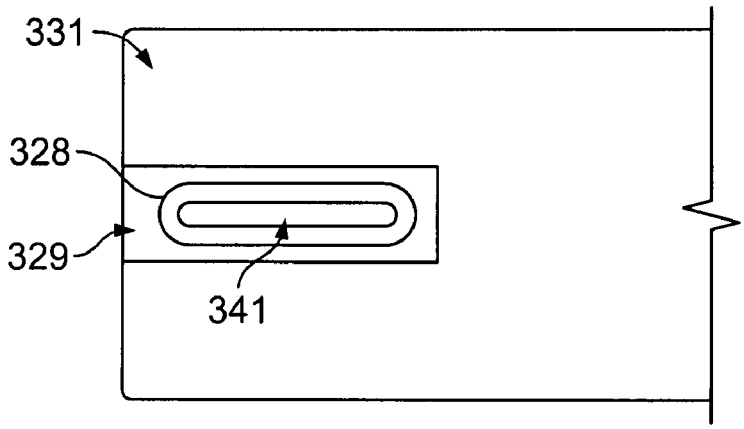
FIG. 9 is a bottom elevational view of a cross section of FIG. 8 taken along lines 9-9.

In the embodiments described herein having a slotted vacuum interface 22, 122, 222, 322, the vacuum interface may include an oblong and/or oval-shaped o-ring vacuum connector 28, 128, 228, 328 in fluid communication with the expansion chamber 20, 120, 220, 320 to releasably couple with the valve 131 and/or other aperture (not shown) disposed on the container 126 to form a vacuum seal with the valve and/or other aperture. Further, the vacuum connector 328, as shown in FIG. 8, may be disposed within a recessed channel 329 configured to accept and/or to guide a narrow, raised, and elongate valve that may be, for example, integrated with and/or associated with a closure mechanism, such as the valve 2023, 3023 disposed in the closure mechanism shown in FIGS. 21-24, and/or that may be, for example, proximal to the side edge of the pouch, as seen in FIG. 4. It is contemplated in the embodiments described herein that formation of a vacuum seal between the vacuum interface 22, 122, 222, 322 and the valve 2023, 3023 (FIGS. 4, 21-24) on the container 126 may cause one or both of a tactile or audible cue to indicate proper establishment of the vacuum seal to ensure efficient evacuation of the container. Further, in this embodiment, the vacuum device 10, 100, 300 may be associated with the container 126 during evacuation in a manner similar to that shown in FIG. 4. It is further contemplated that the oval shaped ring vacuum connector 328 may extend out of the recessed channel 329 below an upper surface 331 of the vacuum interface 322. When viewed from below, as is presented in FIG. 9, an interior circumference of an aperture 341, which the oval-shaped o-ring vacuum connector 328 surrounds, as is seen to be oval-shaped, as well; however, additional configurations of the oval-shaped ring vacuum connector 328 are contemplated herein. As well, the size of the vacuum interface 22, 122, 222, 322 may be adjustable as may be necessary, in order to accommodate containers that may vary in thickness.

Figure 21:
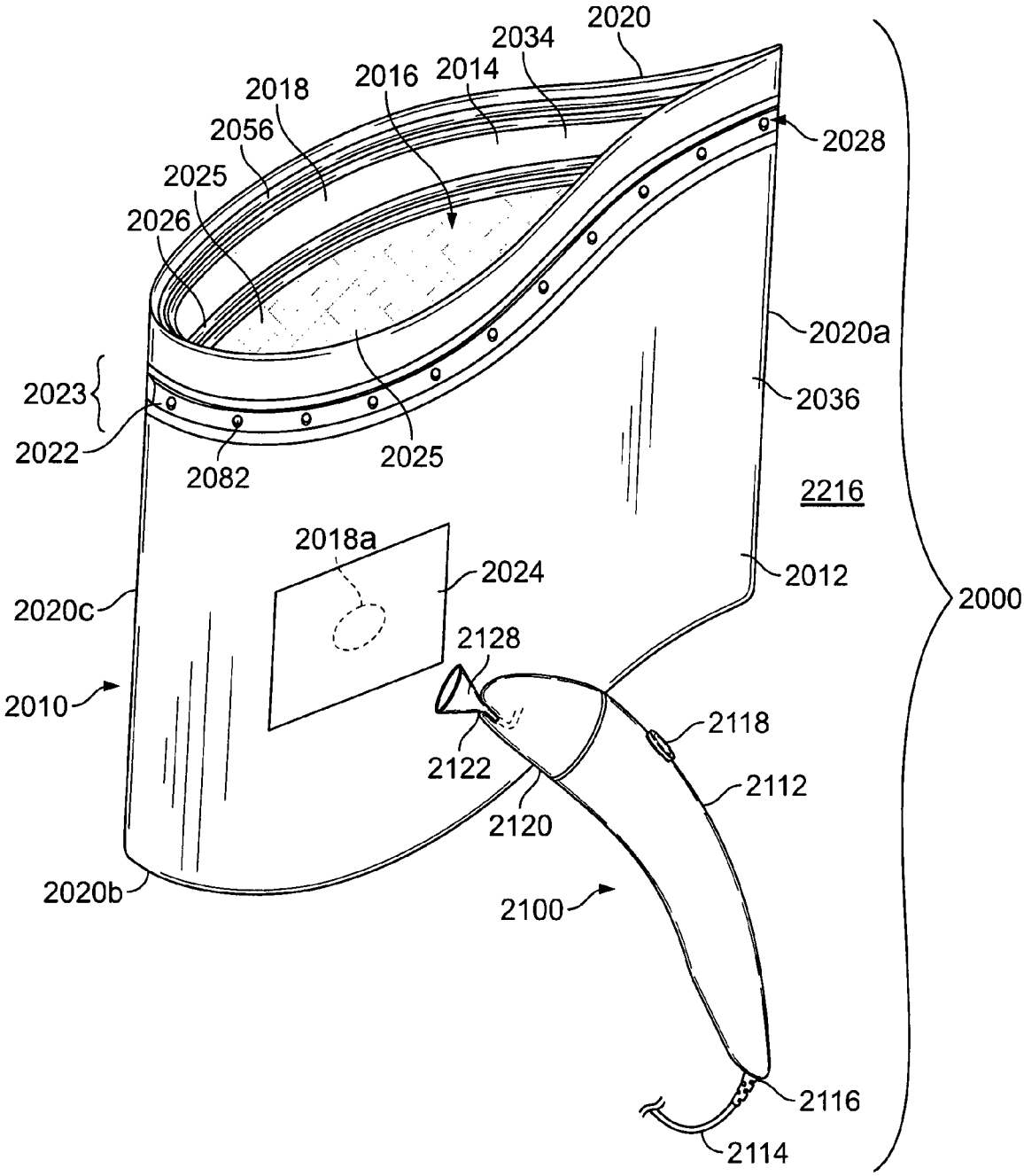
FIG. 21 is a perspective view of a vacuum system according to one embodiment.

In another embodiment seen in FIGS. 10-13, the vacuum interface 422 may have an integral, conical shape and/or suction cup-shaped vacuum connector 428 in place of an oblong and/or oval-shaped ring vacuum connector to enable a vacuum connection between the vacuum device 10 and the valve 131 on the container 126, as shown in FIG. 4, that is located, for example, on a flat surface of the container. Further, as is shown in FIG. 21, the cone-shaped vacuum connector 428, for example, may enable evacuation of the container 2010 having a valve 2024 located in a central portion of a pouch wall 2012. The valve 2024 may be disposed in or cover an opening (not shown) on a first or second sidewall 2012, 2014 of the storage pouch 2010 and spaced from the closure mechanism 2022. Alternatively, the valve may be disposed in or through the closure mechanism (as seen in FIGS. 21-24) or in an opening through a peripheral edge of the pouch, not including the mouth (not shown). The valve 2024 provides a fluid path with direct fluid communication between an interior and an exterior of the pouch.

Further, one or both of the pouch sidewalls 132*a*, 132*b* may be embossed or otherwise textured with a pattern, such as a diamond pattern to create flow channels 2025*j* on one or both surfaces spaced between a bottom peripheral edge of the pouch 2020*b* and the closure mechanism 2022, or a separate textured and embossed patterned wall (not shown) may be used to provide flow channels within an interior of the pouch 2010. The flow channels 2025 may provide fluid communication between the pouch interior and the valve 2024, when fluid is being drawn through the valve. Illustrated flow channels useful in the present invention include those disclosed in, for example, Zimmerman et al. U.S. Patent Application Publication No. 2005/0286808, now U.S. Pat. No. 7,726,880, and Tilman et al. U.S. Patent Application Publication No. 2006/0048483, now U.S. Pat. No. 7,290,660. Other flow channels useful in the present invention include those disclosed in, for example, U.S. Pat. No. 7,887,238, filed on the same day as the present application.

Figure 10:
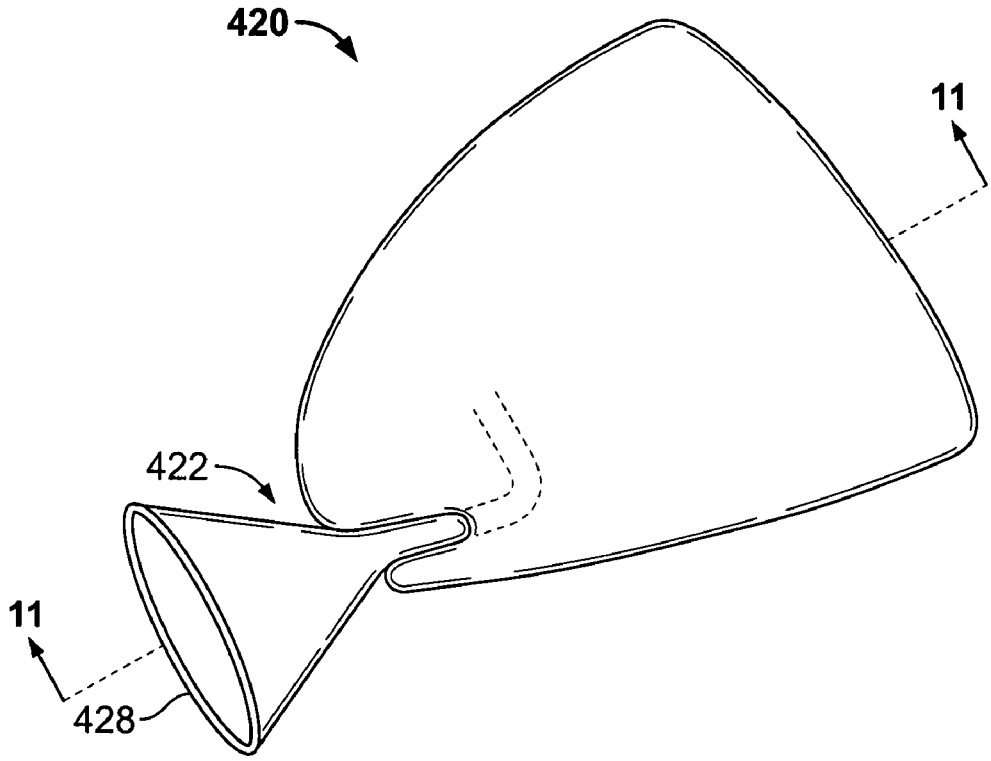
FIG. 10 is a trimetric view of one embodiment of an expansion chamber.
Figure 11:
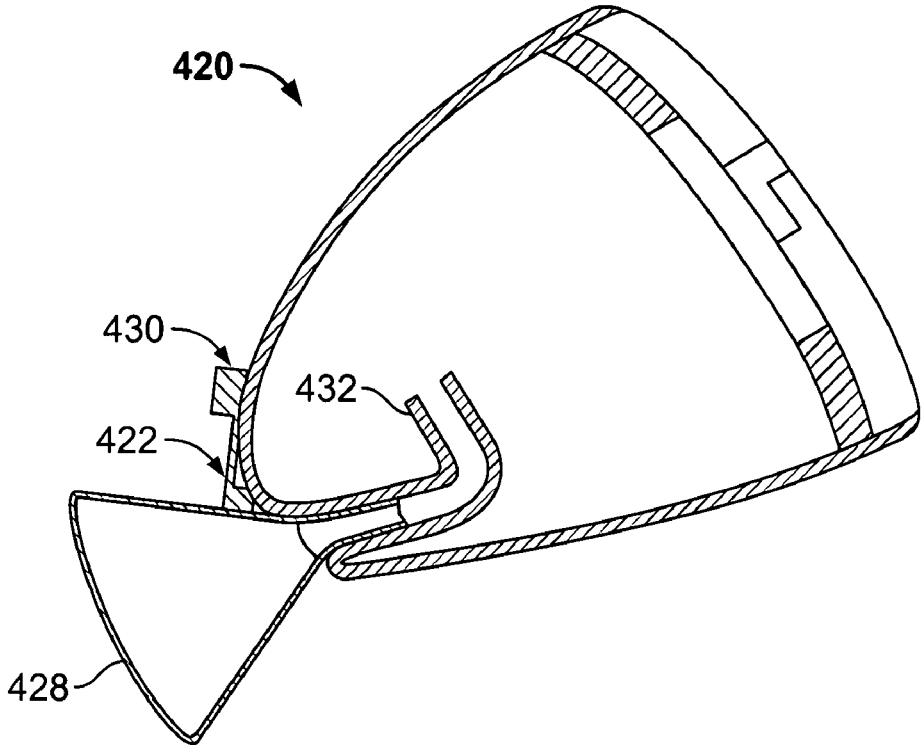
FIG. 11 is a cross-sectional view of the expansion chamber of FIG. 10 taken along lines 11-11.
Figure 12:
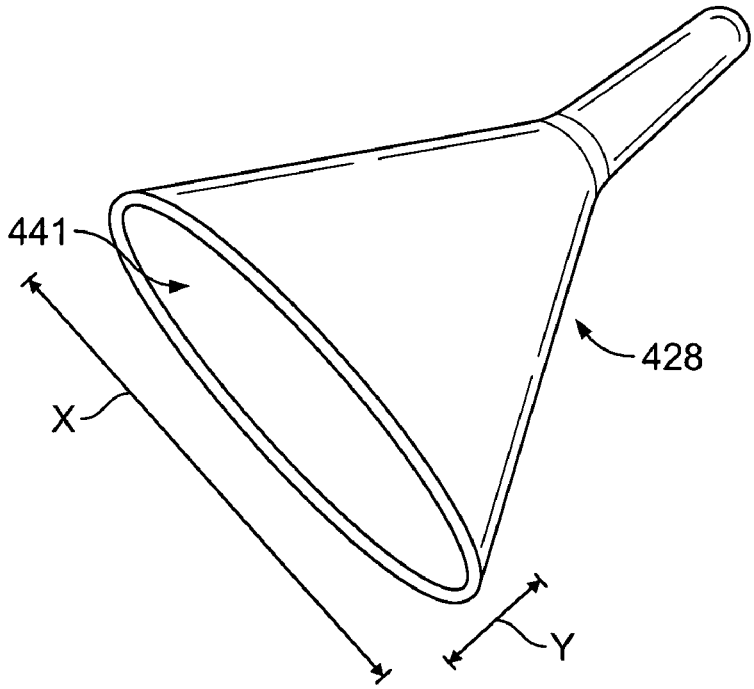
FIG. 12 is a trimetric view of one embodiment of a vacuum connection according to one embodiment.
Figure 13:
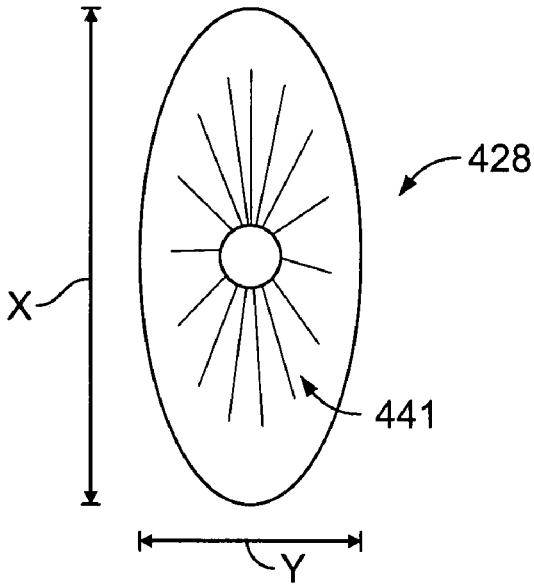
FIG. 13 is an elevational view looking end-on to the vacuum connection of FIG. 12.

In addition, as seen in FIG. 10, a cone-shaped vacuum connector 428 may be removably connected to the expansion chamber 420 through, for example, a force-fit connection. In another embodiment, a release mechanism 430 may releasably secure the cone-shaped vacuum connector 428 to the expansion chamber 420, as is seen in FIG. 11. Further, as is shown in FIGS. 12 and 13, the cone-shaped vacuum connector 428 may have an aperture 441 with an elliptical configuration, such that the length X of the mouth is greater than the width Y of the mouth.

Figure 14:
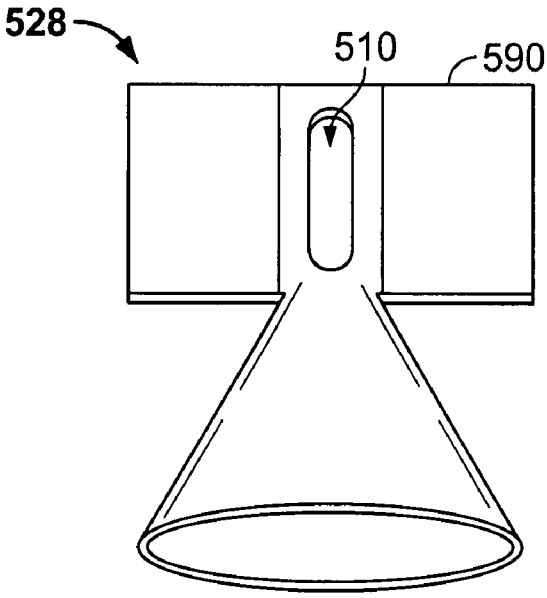
FIG. 14 is a perspective view of a vacuum connection according to another embodiment.

In yet another embodiment seen in FIG. 14, a cone-shaped vacuum connector 528 is connected to or conjoined with a rectangular portion 590 that includes an aperture 510. The rectangular portion 590 is configured to fit into the slotted vacuum interface 22, 122, 222, 322 described above such that the vacuum interface having a slotted interface may be reversibly adapted to hold the cone-shaped vacuum connector 528. It is further contemplated that the rectangular portion 590 and the slotted vacuum interface 22, 122, 222, 322 may be configured such that when the rectangular portion is fitted into the slotted vacuum interface, a tactile cure and/or an audible cure may be indicated when a vacuum connection has been established between the cone-shaped vacuum connector 528 and the expansion chamber 20, 120, 220, 320, as discussed below.

Figure 15:
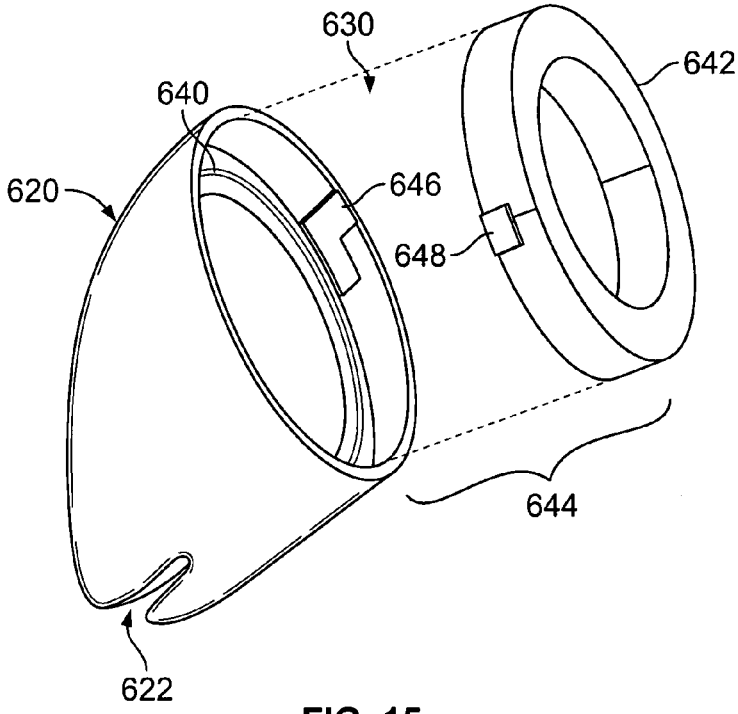
FIG. 15 is a partially exploded view of a vacuum seal according to one embodiment.

In one embodiment, seen in FIG. 15, the expansion chamber 620 is connected releasably to the housing 612 by a vacuum seal 630. The vacuum seal 630 may include a connection such as an o-ring 640 on an end portion 641 of the expansion chamber 620 and/or an end portion 642 of the housing 612, in combination with a quick release mechanism 644 that includes a channel or groove 646 and a complementary raised portion 648. The groove 646 and raised portion 648 may be located on either the expansion chamber 620 and/or the end portion 642 of the housing 612 or both. In this way, to remove the expansion chamber 620 from the housing 612, for example, to empty out and/or to clean the expansion chamber, a user may twist the expansion chamber relative to the housing to interrupt the vacuum seal 630, and thereby release the expansion chamber from the housing. The expansion chamber 620 may then be evacuated and cleaned via the end portion 641, rather than being evacuated through the vacuum interface 622. To reestablish a vacuum connection between the expansion chamber 620 and the housing 612, a user may reverse the steps needed for disassembly of the vacuum device (not shown). Additional connection ways are contemplated herein for joining the expansion chamber 620 and housing 612 of contemplated vacuum devices as are known to one skill in the art, such as male and female threads or an interference fit arrangement.

Figure 16:
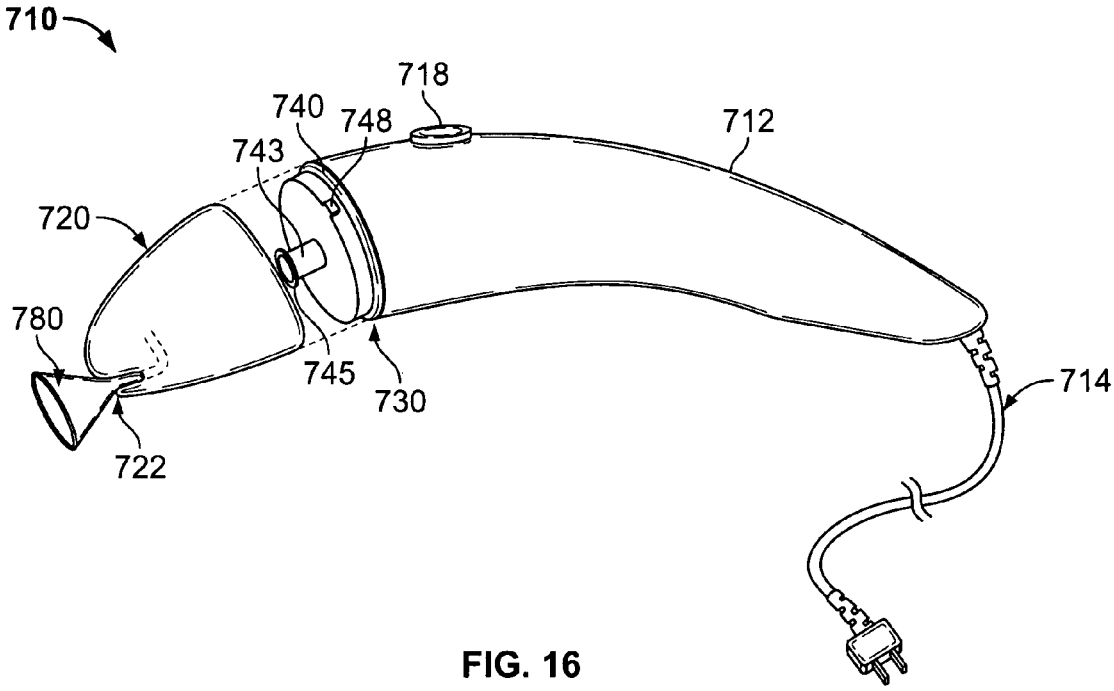
FIG. 16 is a partially exploded view of a vacuum device according to another embodiment.

In another embodiment seen in FIG. 16, the housing 712 may further include a vacuum port 743 that may protrude from the end of the housing to be connected to the expansion chamber 720. The vacuum port 743 provides access to the expansion chamber 720 for a vacuum source (not shown) and is an extension of a vacuum tube (not shown) connecting the vacuum source to the expansion chamber. When the housing 712 and the expansion chamber 720 are joined, the step 743 may extend into the expansion chamber to hinder intake of material into the housing and/or vacuum source from the expansion chamber. It is further contemplated that a cap 745 may be included on the end of the step 743 to further aid in protecting the housing interior and the vacuum source from materials taken into the expansion chamber 720 during use of the vacuum device 710. The cap 745 may be a valve, a filter, a sensor, or an adaptor to allow additional accessories to be added to and/or in the stem and/or expansion chamber 720 and/or to have a desirable shape. It is further contemplated that the cap 745 may reduce the size of the step aperture, change the direction of the vacuum path, and extend the length of the stem.

Figure 17:
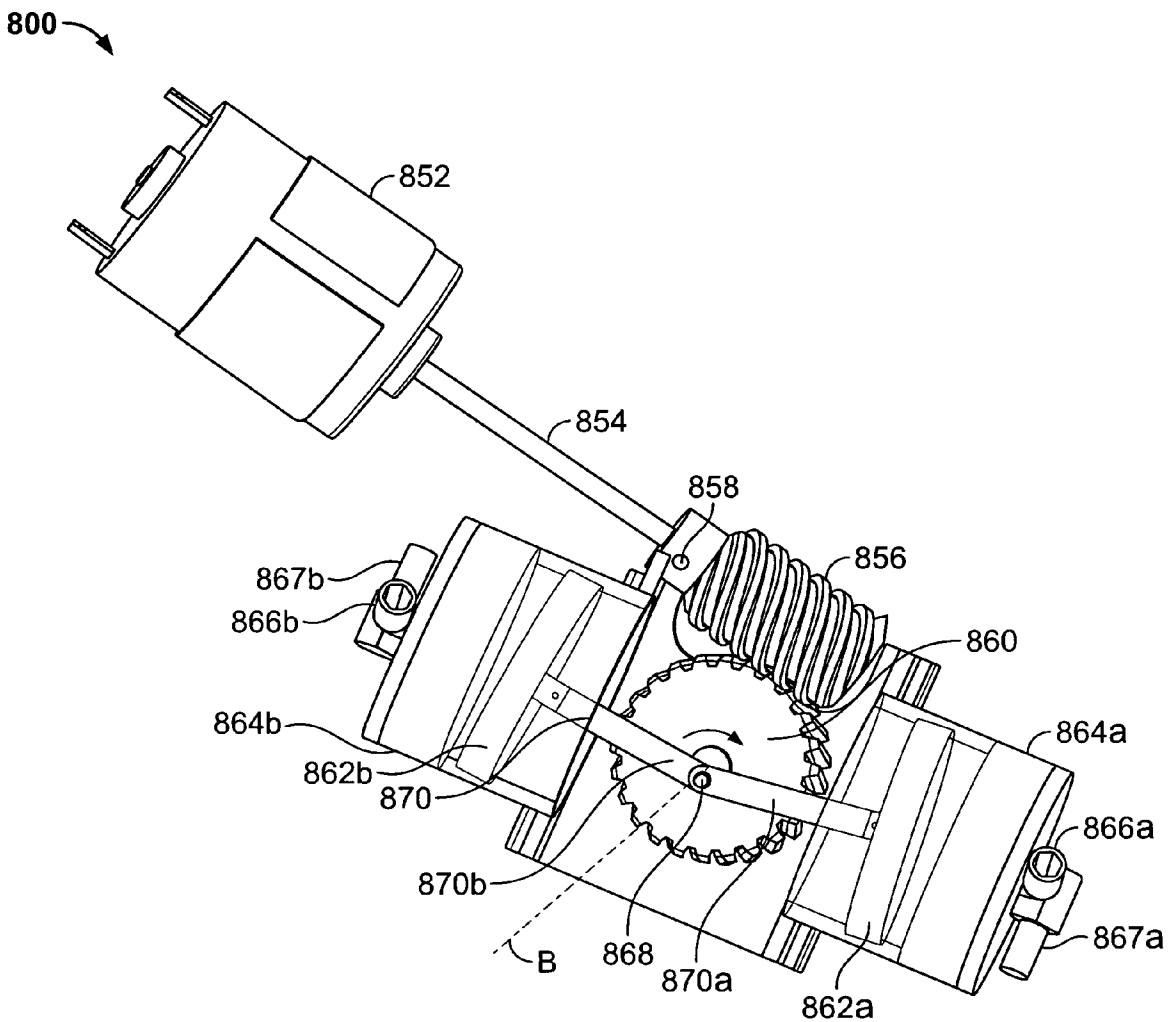
FIG. 17 is a side elevational view of a piston pump according to one embodiment.
Figure 18:
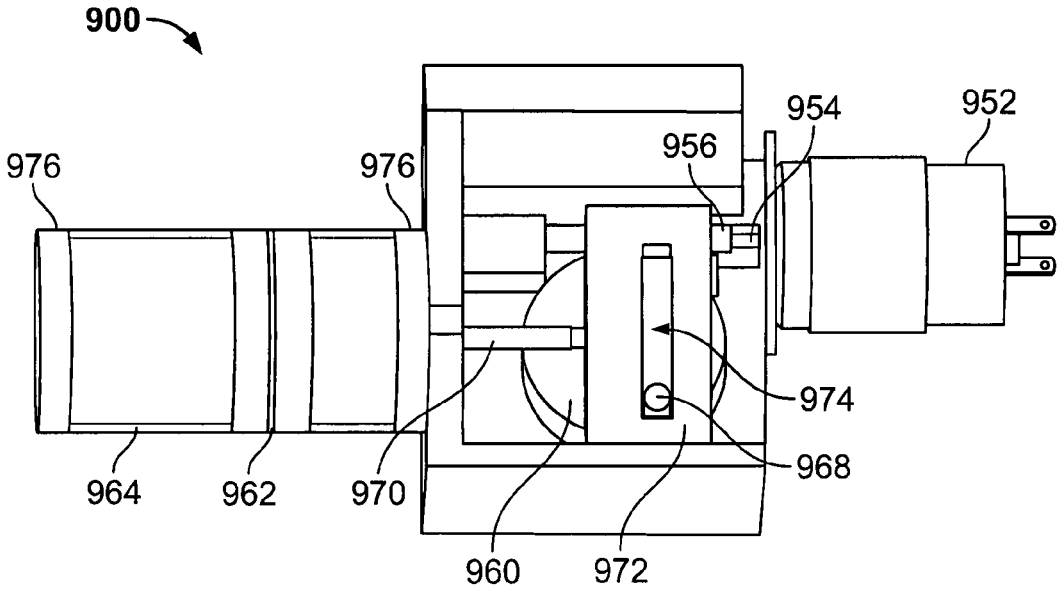
FIG. 18 is a trimetric view of a piston pump according to another embodiment.
Figure 20:
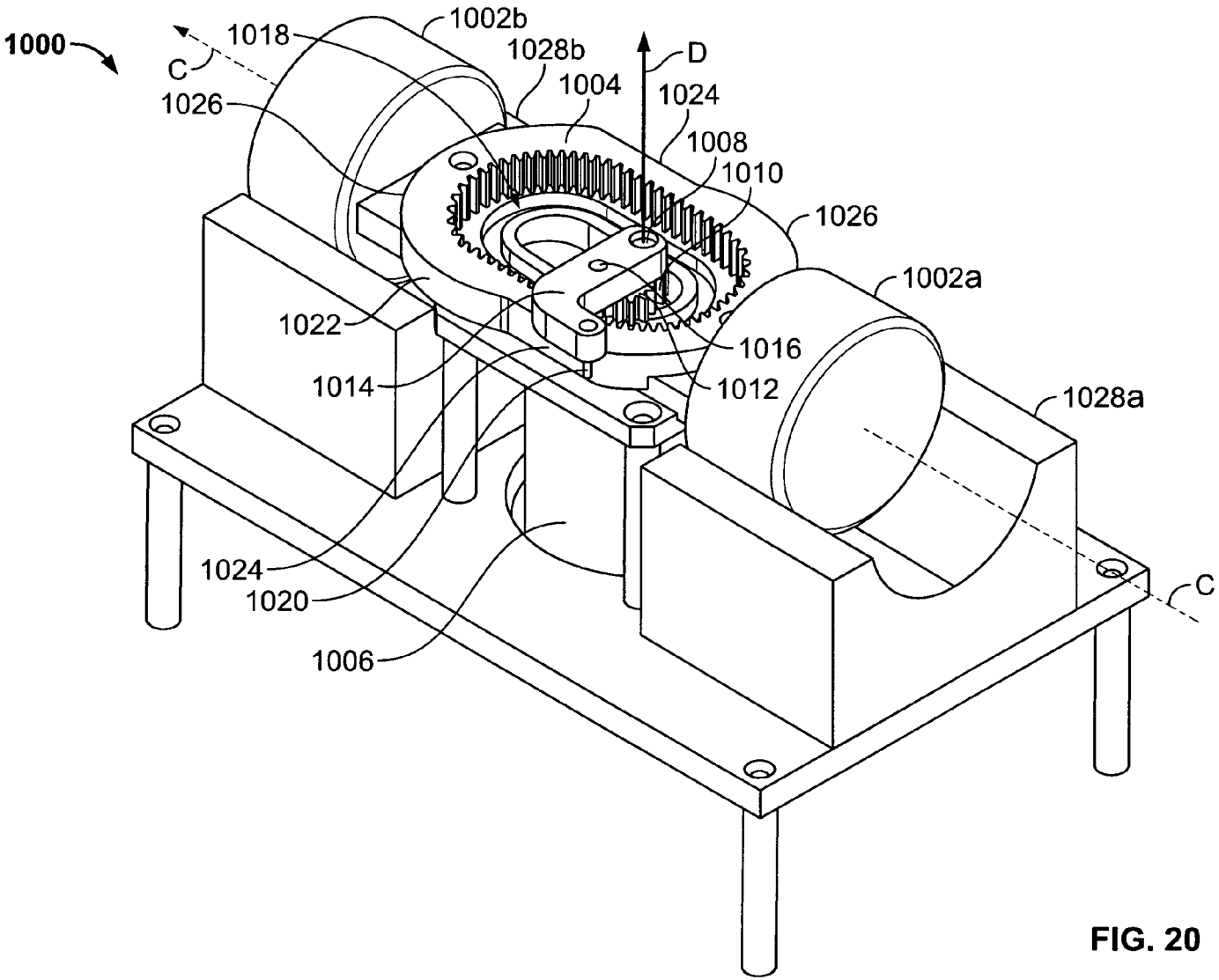
FIG. 20 is a partial cutaway trimetric view of a piston pump according to yet another embodiment.

Illustrative vacuum pumps useful in the present disclosure include those shown in FIGS. 17, 18 and 20. As described more fully below, vacuum pumps may be piston pumps that include one or more cylinders containing one or more pistons. The pistons may be conventional single-action pistons that take in air through a valve during an upstroke or a down stroke and release the air through a separate valve during a down stroke or an upstroke to complete a single cycle. It is further contemplated herein that a piston pump may incorporate a dual-action piston that pumps air during both upstrokes and down strokes via a system of valves, on both ends of a single cylinder. Vacuum pumps of the present disclosure may be driven by an electrical motor powered by one or more batteries, an external electrical cord, other sources known in the art, and any desirable combination thereof. The batteries may be removable for replacement and/or be rechargeable. The electrical motor may be operatively connected to the vacuum pump via a gearing system that translates rotary motion into rectilinear motion to enable a piston to reciprocate within a cylinder.

In the embodiments shown in FIGS. 17, 18 and 20, the piston pumps 800, 900, 1000 may be configured to draw a substantially continuous vacuum for each complete cycle. For example, one half of a complete cycle for a double or dual piston vacuum pump 800, 1000, as shown in FIGS. 17 and 20, may include a first piston 862*a*, 1002*a* that draws air into a first cylinder 864*a*, 1028*a*, while a second piston 862*b*, 1002*b* exhausts air from a second cylinder 864*b*, 1028*b*. During the second half of the cycle, the second piston 862*b*, 1002*b* draws air and the first piston 862*a*, 1002*a* exhausts air from their respective cylinders 864*a*, 1028*a*. Valving (not shown) associated with the first 864*a*, 1028*a* and second cylinder 864*b*, 1028*b* may alternately draw air through the vacuum port 743 (seen in FIG. 16) in fluid connection with the expansion chamber 20, 120, 220, 320, in correspondence with the draw phases of the first and second cylinders, as known by those skilled in the art. In this way, at substantially all times during the cycle, the vacuum pump 800, 1000 is drawing a vacuum, and thus, providing a substantially continuous vacuum. The first 864*a*, 1028*a* and second 864*b*, 1028*b* cylinders may include valves (not shown) to enable a unidirectional flow of air into the cylinder through a first valve 866*a*, 866*b* and out through a second valve 867*a*, 867*b*. Further, the first 862*a*, 1002*a* and second 862*b*, 1002*b* pistons may be exactly out of phase (about 180°), such that as the first piston completes an upstroke, the second piston would complete a down stroke. As an alternative, the first 862*a*, 1002*a* and second 862*b*, 1002*b* piston may be off, being about 180° out of phase, such that the first piston begins an upstroke before the second piston would complete a down stroke. In this way, a substantially continuous vacuum may be drawn by the vacuum pump 800, 1000. In the case of a dual-action piston 962 as described above, a complete cycle may include one upstroke and one down stroke, during each of which, the piston alternately draws air and exhausts air on opposite sides of the piston head.

Drawing a substantially continuous vacuum may enable a more linear and potentially a faster decrease in pressure from a container being evacuated as compared to a standard vacuum device with a conventional single piston that provides a pulsed or stepped decrease in pressure due to a requisite lag phase that follows each draw phase, for example, a drawing upstroke would be followed by an exhausting down stroke. Substantially continuous vacuum piston pumps minimize such a lag phase and may thus potentiate a more efficient and/or faster evacuation of a container from which a material is being extracted. Substantially continuous vacuum piston pumps may also use less energy to evacuate certain containers. For example, a container with a valve that utilizes a tacky or an adhesive sealing method may be evacuated more efficiently using a substantially continuous vacuum piston pump, because the valve would remain open throughout the evacuation rather than closing intermittently during drops in or plateauing of pressure during lag phases of a conventional piston pump. In addition, greater efficiency associated with substantially continuous vacuum piston pumps leads to a more efficient motor use that may extend motor and/or battery life and/or conserve electricity.

Illustratively for a hand-held vacuum device including those shown in FIGS. 1-4, 8, and 16, for use in a typical household situation to evacuate a one gallon or less container, a vacuum drawn by a piston pump 800, 900, 1000 of the present disclosure through the expansion chamber 20, 120, 320, 720 may range, for example, from about 3 to about 30 in. Hg, or from about 4 to about 20 in. Hg, or from about 12 to about 25 in. Hg. As well, a piston pump 800, 900, 1000 of the present disclosure may generate a flow rate through the expansion chamber 20, 120, 320 720 of about 0.15 to about 1.5 cfm or from about 0.5 to about 0.75 cfm. It is contemplated that greater and lesser ranges may be achieved by piston pumps 800, 900, 1000 of the present disclosure, depending on the size and configuration of the piston pumps and drive mechanisms, and/or the intended use of the vacuum device.

Referring now to FIG. 17, a dual piston pump 800 includes an electrical motor 852 having a motor shaft 854 with a motor gear 856, such as, for example, a pinion or a worm gear on one end thereof. Illustratively, the motor gear 856 may be attached to the motor shaft 854 by a screw mount 858. One or more gears 860 or one or more gearing systems may also be directly or indirectly enmeshed with the motor gear 856 to translate the rotary motion of the motor gear into rectilinear motion to enable a piston 862*a*, 862*b* to reciprocate within a cylinder 864*a*, 864*b*. Examples of suitable gears include, for example, a crown gear and/or a worm-gear wheel. For example, in FIG. 17, the motor gear 856 is a worm gear that is enmeshed with a worm-gear wheel 860 that has an axis of rotation (arrow B) at or approaching about 90 degrees to the axis of rotation of the motor shaft 854. Describing one side of the dual piston pump 850, which may be either side, reciprocatory motion may be imparted to the piston 862*a* within the cylinder 864*a* that has a check-valve 866 or other valve on one end thereof by the worm-gear wheel 860 via an eccentrically placed pin 868 to which a piston rod 870 is operatively attached to the piston. The piston rod 870*a* may be rigidly attached to the piston 862*a*, or alternatively, the piston rod may be pivotally attached to the piston.

By varying the point of attachment of the piston rod 870*a*, 8701*b* on the worm-gear wheel 860, the piston stroke length, number of strokes per minute, and phase of the first piston and the second piston with respect to each other may be adjusted accordingly at a given number of revolutions by the electrical motor 852. Alternatively or in addition to altering placement of the pin 868 to achieve the above-mentioned variations, the motor gear 856 may be enmeshed with a transmission (not shown) that includes one or more gears to increase or to decrease the power provided by the electrical motor 852 to the piston 862*a*, 862*b*. Additional gear sizes, as well as different gearing system, for example, that incorporate a belt, a pulley, a chain, or a combination thereof are contemplated for driving piston pumps contemplated herein.

Referring now to FIG. 18, a dual-action piston pump 900 according to one embodiment is shown. The dual-action piston pump 900 draws and pushes air on each upstroke and each down-stroke of a single piston 962. The dual-action piston pump 900 includes an electrical motor 952, a motor shaft 954, a motor gear 956, and a worm-gear wheel 960 with an eccentrically placed pin 968 similar to that of the dual piston pump 950 described above. A single cylinder 964 houses the piston 962 that is rigidly connected to a piston rod 970. In the embodiment shown, the piston rod 970 has a bracket 972 located opposite to the piston 962. The bracket 972 has a slot 974 disposed therein that accepts the pin 968 of the worm-gear wheel 960. During operation, the worm-gear wheel 960 revolves, causing the pin 968 to reciprocate within the slot 974 of the bracket 972, and in so doing, the piston rod 970 and piston 962 are reciprocated within the cylinder 964.

Figure 19:
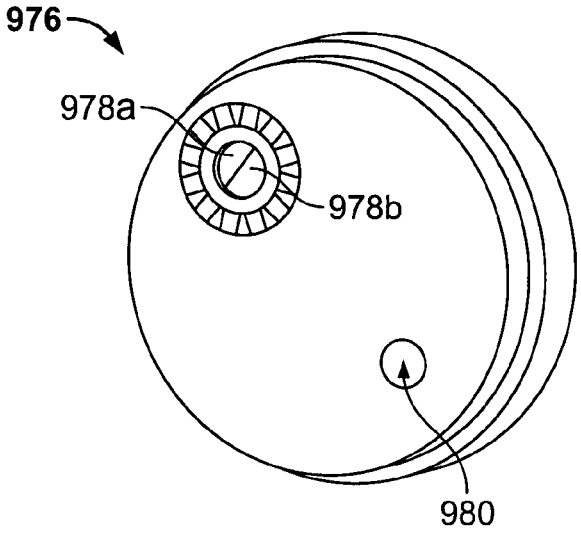
FIG. 19 is a trimetric view of a piston end cap according to one embodiment.

The cylinder 964 further includes a cylinder end cap 976 on both ends thereof. The cylinder end cap 976, as shown in FIG. 19, has a pair of one-way valves 978*a*, 978*b* and, as shown, an aperture 980 for passage of the piston rod 970. The cylinder end cap 976 opposite to the motor may lack an aperture 980 or the aperture may be plugged using suitable means known to one skilled in the art. The cylinder end caps 976 present on opposite ends of the cylinder 964 of the dual-action pump 900 enable air to be drawn into the cylinder on one side of the piston 962 when the piston moves in one direction, while air is pushed out of the cylinder on the opposite side of the piston.

FIG. 20 presents another embodiment contemplated herein that includes a dual piston pump 1000, though a configuration including one or two dual-action pistons is contemplated, as well. In the illustrated embodiment, two pistons 1002*a*, 1002*b* share a central axis (arrow C) and are rigidly attached to opposite ends of an oval rack gear 1004. An electrical motor 1006 includes a drive shaft 1008, to which a motor gear 1010, is attached. A planetary gear 1012 is enmeshed with the motor gear 1010 and the oval rack gear 1004. The planetary gear 1012 is carried by an L-arm 1014 via a pin 1016 that extends through the planetary gear and beyond a lower side of the planetary gear to travel within an interior track 1018 of the oval rack gear 1004 as the oval rack gear reciprocates upon activation of the electrical motor 1006. Further, the L-arm 1014 is pivotally secured to an end of the drive shaft 1008 above the motor gear 1010 and includes a guide pin 1020 that engages an exterior side surface 1022 of the oval rack gear 1004. In this way, the L-arm 1014 holds the planetary gear 1012 within the interior track 1018 and stationary against straight sections 1024 of the oval rack gear 1004, and allows the planetary gear to orbit around the motor gear 1010 at the curved end sections 1026 of the oval rack gear, thereby reciprocating the oval rack gear along a path parallel to the axis (arrow C) of the pistons 1002*a*, 1002*b* within opposing cylinders 1028*a*, 1028*b*, which are shown in the cross section for clarity.

FIG. 21 presents a vacuum system 2000 according to one embodiment. The vacuum system 2000 includes a resealable pouch 2010 having a first sidewall 2012 and a second sidewall 2014 that are connected, such as by folding, heat seal, and/or adhesive, along three peripheral edges 2020*a*, 2020*b*, and 2020*c* to define an interior space 2016 therebetween and an opening 2018 along a top edge 2020 where the first and second sidewalls 2012, 2014 are not connected, so as to allow access to the interior space 2016. A resealable elongate closure mechanism 2022 along the first and second sidewalls 2012, 2014 near the opening 2018 extends between the peripheral edge 2020*a* and the peripheral edge 2020*c* of the pouch 2010 to allow the opening 2018 to be repeatedly occluded and deoccluded, thereby sealing and unsealing, respectively, the opening 2018. Protuberances, such as ridges 2056, may be disposed near the opening 2018 to provide increased traction in a convenient area for a user to grip, such as a gripping flange, when trying to open a sealed pouch.

When occluded, the closure mechanism 2022 provides an airtight seal, such that a vacuum may be maintained in the pouch interior 2016 for a desired period of time, such as days, months, or years, when the closure mechanism is sealed fully across the opening 2018. In one embodiment, the pouch 2010 may include a second opening 2018*a* through one of the sidewalls 2012, 2014 covered by a valve 2024, such as a check or one-way valve, to allow air to be evacuated from the pouch interior 2016 and to maintain a vacuum when the closure mechanism 2022 has been sealed. As shown in FIG. 21, the valve 2024 may be disposed on the first sidewall 2012 spaced from the closure mechanism 2022. The valve 2024 provides a fluid path with direct fluid communication between the pouch interior 2016 and an exterior 2216 of the pouch 2100.

The closure mechanism 2022 includes a first closure element 2026 that releasably interlocks and seals with an opposing second closure element 2028. Each of the closure elements 2026, 2028 has a substantially constant elongate cross-sectional profile that extends longitudinally between the peripheral edge 2020*a* and the peripheral edge 2020*c* of the pouch 2010 to form a continuous seal therealong when fully interlocked with the opposing closure element. In one embodiment, the first closure element 2026 is disposed on an interior surface 2034 of the second sidewall 2014 and the second closure element 2028 is disposed along an exterior surface 2036 of the first sidewall 2012. In other embodiments, the orientation of the closure elements 2026, 2028 with respect to the sidewalls 2012, 2014 may be reversed accordingly.

The vacuum system 2000 further includes a vacuum device 2100 similar to those described above to evacuate fluid from the pouch 2010 through, for example, the valve 2024 disposed in one side of the walls 2012, 2014. The vacuum device 2100 includes a housing 2112 that holds a vacuum source (not shown) and an expansion chamber 2120 in fluid communication with the housing. The vacuum device 2100 includes an electrical cord 2114 attached to the housing 2112 via a swivel connection 2116 to power the vacuum source. The vacuum devices 2100 further includes a user-activated switch 2118 for activation of the vacuum source. A vacuum interface 2122 includes an integral, conical shape and/or suction cup-shaped vacuum connector 2128 to enable a vacuum connection between the vacuum device 2100 and the valve 2024 on the pouch 2010.

Figure 22:
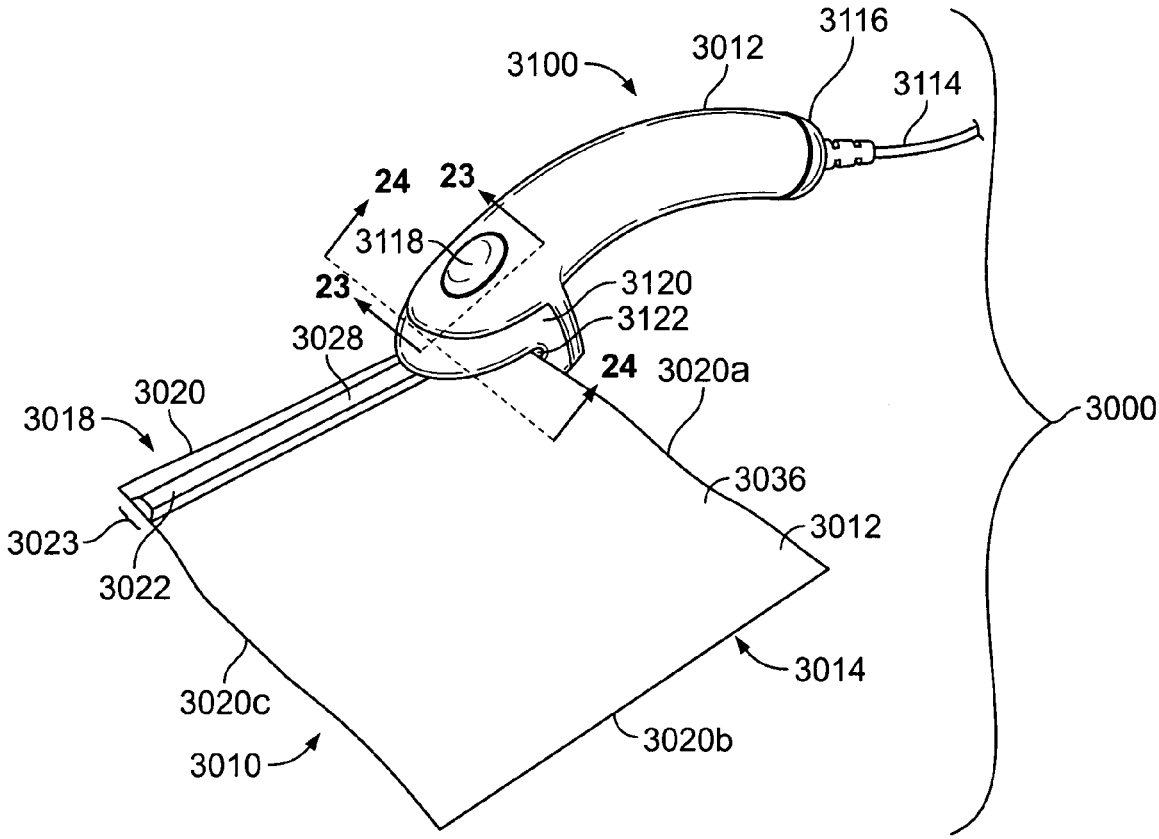
FIG. 22 is a perspective view of a vacuum system according to another embodiment.

FIG. 22 illustrates another embodiment of a vacuum system 3000 with the resealable pouch 3010 and the vacuum device 3100 in vacuum communication. The resealable pouch 3010 has a first sidewall 3012 and an opposing second sidewall 3014 connected along three peripheral edges 3020*a*, 3020*b*, and 3020*c* to define an interior space (not shown) therebetween and an opening (not shown) along a top edge 3020 where the first and second sidewalls 3012, 3014 are not connected, so as to allow access to the interior space 3016. A resealable elongate closure mechanism 3022 along the first and second sidewalls 3012, 3014 near the opening 3018 extends between the peripheral edge 3020*a* and the peripheral edge 3020*c* of the pouch 3010 to allow the opening to be repeatedly occluded and deoccluded, thereby sealing and unsealing, respectively, the opening. Internal and external elements of the closure mechanism 3022 (discussed below in reference to FIG. 24) form a valve 3023 that enables a slotted vacuum interface 3122 to form a vacuum connection with the pouch 3010.

The vacuum device 3100 includes a housing 3112 that holds a suitable vacuum source and an expansion chamber 3120 in fluid communication with the housing to which an electrical cord 3114 is attached via a swivel connection 3116, to power the vacuum source. A user-activated switch 3118 can be used to activate the vacuum source. A vacuum interface 3122 has a slotted configuration, similar to those described above, to enable a vacuum connection between the vacuum device 3100 and the pouch 3010 to be established upon guiding the closure mechanism 3022 and the valve 3023 into a recessed channel 3329 (seen in FIG. 24) of the vacuum interface. In a manner similar to that depicted in FIG. 4, the pouch 3010 and the vacuum device 3100 may be interlockingly engaged via the valve 3023 with the vacuum interface 3122 to enable fluid to be drawn through apertures 3082 in the closure element 3028 disposed on the exterior surface 3036 of the sidewall 3012 and into the expansion chamber 3120 of the vacuum device 3100. In the embodiment shown, the vacuum system 3000 is configured for both hand-held and hands-free operation.

Figure 23:
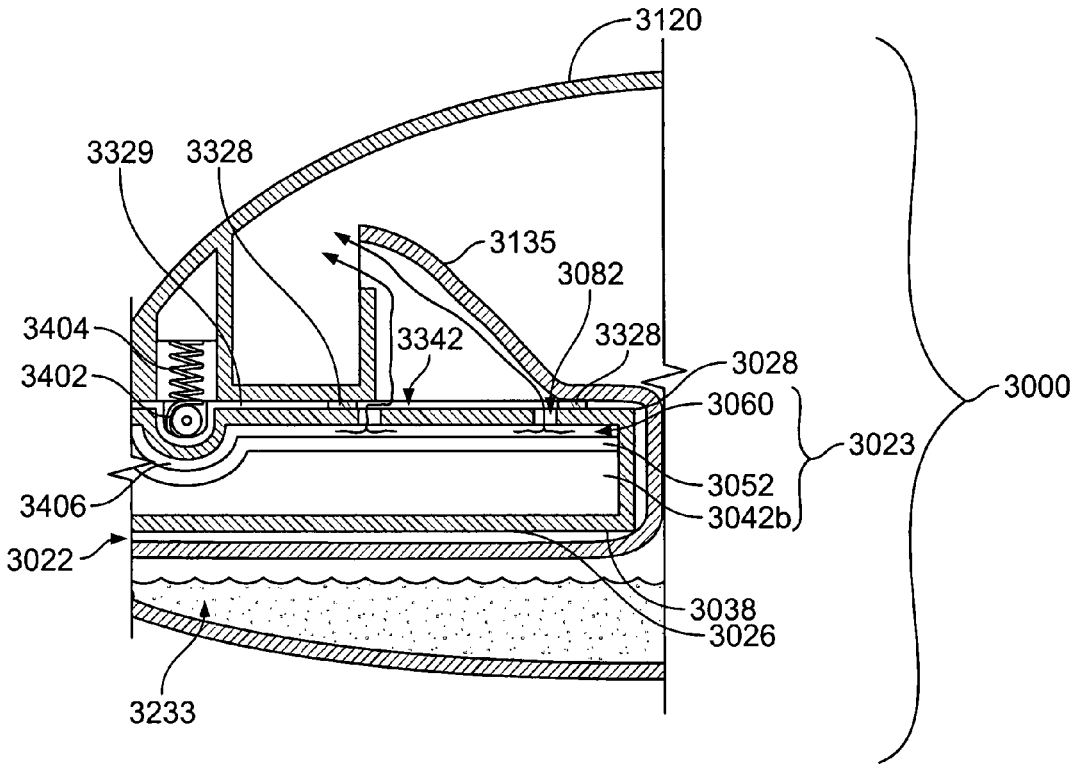
FIG. 23 is a cross-sectional view of the vacuum system of FIG. 22 taken along lines 23-23.

Proper alignment and establishment of a vacuum connection between the valve 3023 and a vacuum connector 3328 (seen in FIG. 24) disposed within the recessed channel 3329 may be indicated by an audible and/or a tactile cue. As shown in cross section generally along lines 23-23 of FIG. 22 (and along post 3042*b* of FIG. 24, see below), FIG. 23 depicts the valve 3023 inserted into the recessed channel 3329 of the expansion chamber 3120 to enable, for example, a spring-loaded button 3402 attached to a spring 3404 secured to the expansion chamber to snap into a depression 3406 in the closure element 3028 with sufficient force to create an audible and/or a tactile cue. Other snap-fit connection mechanisms known to one skilled in the art are also contemplated for inclusion herein. The spring-loaded button 3402, depression 3406, and vacuum connection 3328 are configured so that concomitant with the audible and/or tactile cue, a vacuum connection is established between one or more apertures 3082 associated with the valve 3023 and the internal volume of the expansion chamber 3120 via the vacuum connector. Thus established, the vacuum connection allows fluid to be drawn from the pouch 3010 into the expansion chamber 3120, where liquids 3233 or the materials may be held.

Figure 24:
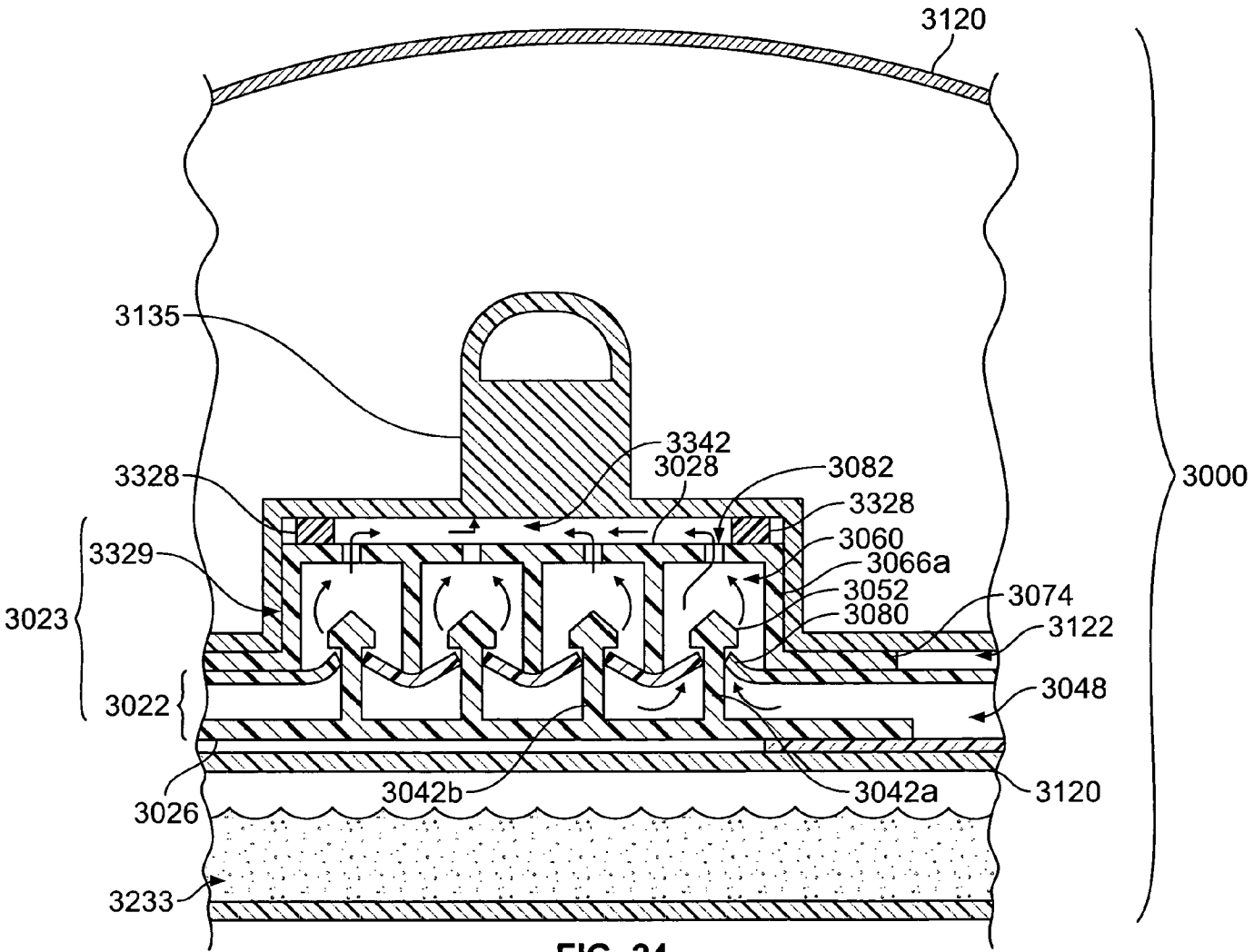
FIG. 24 is a cross-sectional view of the vacuum system of FIG. 22 taken along lines 24-24.

An enlarged partial cross section taken generally along lines 24-24 of the interlocking engagement of the closure mechanism 3022 with the vacuum interface 3122 of the vacuum system of FIG. 22, is shown in FIG. 24. This figure illustrates a vacuum connection between the valve 3023 and the vacuum connector 3328 of the expansion chamber and the extraction of fluid 3233 (depicted from arrows) from an interior side 3048 of the closure elements or profiles 3026, 3028 of the pouch 3010.

For clarity, the following description of one contemplated embodiment for the valve 3023 within the closure mechanism refers only to one portion of the valve within the closure mechanism during the application of a vacuum by the vacuum device 3100, where a vacuum connection has been established between the pouch 3010 and the vacuum device 3100. This description applies similarly to the remainder of the closure mechanism 3022, as indicated by the curved arrows. Induction of a vacuum by the vacuum device 3100 draws fluid from the interior of the pouch 310 past a cantilevered flap 3080 extending from a flange 3074 toward a post 3042*a* with an arrow-shaped head 3052 disposed thereon. The fluid is then drawn into a channel 3060 formed between an exterior leg 3066*a* and the post 3042*a* and out of the pouch 3010 through apertures 3082 disposed on an end of the closure element 3028 and aligned with a space 33342 between the closure element and an aperture (not shown) leading into a deflector 3235 of the expansion chamber 3120.

Figure 25:
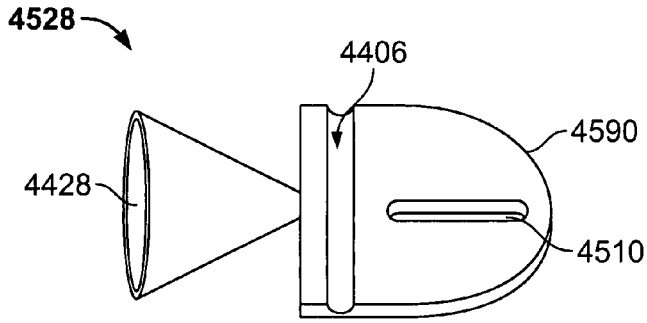
FIG. 25 is a perspective view of a vacuum adaptor according to one embodiment.

Another embodiment contemplated herein is shown in FIG. 25, in which a vacuum adaptor 4528 includes a cone-shaped vacuum connector 4428 connected to or conjoined with a docking portion 4590 configured to fit into the slotted vacuum interface 22, 122, 222, 322, 22, 2122, 3122 of the expansion chamber 20, 120, 220 320, 620, 2120, 3120. Upon insertion of the docking portion 4590 into the vacuum interface 22, 122, 222, 322, 622, 2122, 3122, a spring-loaded button 3402 (see FIG. 23) or similar device snaps into a depression 4406 to produce an audible and/or a tactile cue to indicate establishment of a vacuum connection between an aperture 510 in the docking portion 4590 and the interior volume of the expansion chamber 20, 120, 220, 320, 620, 2120, 3120. In this way, the vacuum interface 22, 122, 222, 322, 622, 2122, 3122 may be reversibly fit with a cone-shaped vacuum connector 4428. In addition to the above described configurations, additional lock and key configurations known to one skilled in the art that produce an audible and/or a tactile cue, to indicate establishment of a vacuum connection, are contemplated herein.

INDUSTRIAL APPLICABILITY

The present disclosure provides a vacuum device that enables the evacuation of storage containers, such as a vacuum storage pouch, through valves on the containers. Expansion chambers separate materials evacuated from the containers to protect vacuum sources and to prolong usage of the vacuum devices. The piston pumps utilized herein may also provide an efficient vacuum source by providing a substantially continuous vacuum.

Numerous modifications will be apparent to those skilled in the art in view of the foregoing description. Accordingly, this description is to be construed as illustrative only and is presented for the purpose of enabling those skilled in the art to make and to use the invention and to teach the best mode of carrying out the same. The exclusive rights to all modifications within the scope of the impending claims are reserved. All patents, patent publications and applications, and other references cited herein are incorporated by reference herein in their entirety.

We claim:

1. A hand-held vacuum device for evacuating a container, the device comprising:

a housing to hold an electrical motor operable to drive a piston pump and a piston valve, the piston pump and the piston valve being configured to draw a substantially continuous vacuum during each complete cycle of the piston pump, wherein the piston pump comprises a first cylinder having a first piston and a first check-valve and a second cylinder having a second piston and a second check-valve, a first piston shaft eccentrically connected to a worm gear wheel and the first piston and a second piston shaft eccentrically connected to the worm gear wheel and the second piston, wherein the electrical motor is operatively connected to a worm gear that drives the worm gear wheel to reciprocate the first piston and the second piston within the first cylinder and the second cylinder to draw the substantially continuous vacuum;

an expansion chamber releasably connected to and in fluid communication with the housing and the piston pump, the expansion chamber having a deflector to alter a fluid pathway of a fluid before entering an interior volume of the expansion chamber; and a vacuum interface having a vacuum connecter in fluid communication with the expansion chamber and configured to releasably couple to a valve disposed on a container to form an airtight seal therewith, wherein the expansion chamber separates air and liquid from the fluid drawn into the interior volume of the expansion chamber and collects the liquid therein.

2. The hand-held vacuum device of claim 1, wherein the vacuum interface has a slot to receive a guide member disposed on the container to align an aperture on the vacuum interface with the valve disposed on the container.

3. The hand-held vacuum device of claim 2, wherein the aperture is surrounded by an oval-shaped o-ring seal to form an airtight seal between the expansion chamber and a valve disposed on the container.

4. The hand-held vacuum device of claim 2, wherein the vacuum interface is configured to accept a side edge of a pouch and form the airtight seal with the valve on a pouch wall proximal to the side edge.

5. The hand-held vacuum device of claim 2, wherein the guide member is adapted to be a closure mechanism with a valve disposed in the closure mechanism.

6. The hand-held vacuum device of claim 2, wherein the guide member is adapted to be a closure mechanism with a valve disposed proximate to the closure mechanism.

7. The hand-held vacuum device of claim 1, wherein the expansion chamber includes a window to allow a user to monitor an amount of the liquid held within the expansion chamber.

8. The hand-held vacuum device of claim 1, wherein the housing further comprises a switch and a power cord attached thereto.

9. The hand-held vacuum device of claim 1, wherein the housing and the expansion chamber are configured so as to enable the vacuum device to be used in a hand-held mode and a hands-free mode.

10. The hand-held vacuum device of claim 1, wherein the deflector comprises at least one of an angled tube and a narrowing tube.

11. The hand-held vacuum device of claim 10, wherein the angle of the tube is about 10° or greater from horizontal.

12. The hand-held vacuum device of claim 1, wherein the vacuum connector is at least one of an oval-shaped o-ring and a suction cup-shaped vacuum connector.

13. The hand-held vacuum device of claim 1, wherein the expansion chamber is releasably connected to the housing by a quick release mechanism.

14. The hand-held vacuum device of claim 1, wherein the substantially continuous vacuum drawn by the piston pump through the expansion chamber is from about 10 to about 30 in. Hg.

15. The hand-held vacuum device of claim 1, wherein the piston pump generates a flow rate through the expansion chamber of about 0.25 to about 1.0 cfm.

16. A vacuum system comprising:

a hand-held vacuum device comprising a housing including a piston pump comprising a first cylinder having a first piston and a first check-valve and a second cylinder having a second piston and a second check-valve, an electrical motor operatively connected to a worm gear and a worm gear wheel, a first piston shaft eccentrically connected to the worm gear wheel and the first piston and a second piston shaft eccentrically connected to the worm gear wheel and the second piston, an expansion chamber having an internal reservoir and a vacuum connector capable of forming a vacuum seal with a pouch valve, wherein the expansion chamber is releasably secured to the housing to enable access to the reservoir and prevents fouling of the piston pump when a vacuum is drawn through the vacuum interface; and a container having a valve disposed thereon to provide fluid communication with the hand-held vacuum device.

17. A vacuum system comprising:

a hand-held vacuum device comprising a housing including a dual action piston pump comprising a cylinder having a piston, an electrical motor with a drive shaft with a worm gear attached thereon and in cooperative engagement with a worm gear wheel, a piston shaft eccentrically connected to the worm gear wheel, a plurality of one-way valves associated with a proximal end and a distal end of the cylinder to allow a vacuum to be drawn substantially continuously by the dual action piston pump as the piston is reciprocated from the distal end and from the proximal end, an expansion chamber having an internal reservoir and a vacuum connector capable of forming a vacuum seal with a pouch valve, wherein the expansion chamber is releasably secured to the housing to enable access to the reservoir, and prevents fouling of the piston pump when a vacuum is drawn through the vacuum interface; and a container having a valve disposed thereon to provide fluid communication with the hand-held vacuum device.

18. A hand-held vacuum device for evacuating a container, the device comprising:

a housing to hold an electrical motor operable to drive a piston pump and a piston valve, the piston pump and the piston valve being configured to draw a substantially continuous vacuum during each complete cycle of the piston pump, wherein the piston pump comprises a dual action piston pump that includes a cylinder having a piston, a drive shaft with a worm gear attached to the electrical motor and in cooperative agreement with a worm gear wheel, a piston shaft eccentrically connected to the worm gear wheel, a plurality of end-caps associated with a proximal end and a distal end of the cylinder to allow the substantially continuous vacuum to be drawn continuously by the dual action piston pump as the piston is reciprocated from the distal end and from the proximal end;

an expansion chamber releasably connected to and in fluid communication with the housing and the piston pump, the expansion chamber having a deflector to alter a fluid pathway of a fluid before entering an interior volume of the expansion chamber; and a vacuum interface having a vacuum connecter in fluid communication with the expansion chamber and configured to releasably couple to a valve disposed on a container to form an airtight seal therewith, wherein the expansion chamber separates air and liquid from the fluid drawn into the interior volume of the expansion chamber, and collects the liquid therein.

19. The hand-held vacuum device of claim 18, wherein the vacuum interface has a slot to receive a guide member disposed on the container to align an aperture on the vacuum interface with the valve disposed on the container.

20. The hand-held vacuum device of claim 19, wherein the aperture is surrounded by an oval-shaped o-ring seal to form an airtight seal between the expansion chamber and a valve disposed on the container.

21. The hand-held vacuum device of claim 19, wherein the vacuum interface is configured to accept a side edge of a pouch and form the airtight seal with the valve on a pouch wall proximal to the side edge.

22. The hand-held vacuum device of claim 19, wherein the guide member is adapted to be a closure mechanism with a valve disposed in the closure mechanism.

23. The hand-held vacuum device of claim 19, wherein the guide member is adapted to be a closure mechanism with a valve disposed proximate to the closure mechanism.

24. The hand-held vacuum device of claim 18, wherein the expansion chamber includes a window to allow a user to monitor an amount of the liquid held within the expansion chamber.

25. The hand-held vacuum device of claim 18, wherein the housing further comprises a switch and a power cord attached thereto.

26. The hand-held vacuum device of claim 18, wherein the housing and the expansion chamber are configured so as to enable the vacuum device to be used in a hand-held mode and a hands-free mode.

27. The hand-held vacuum device of claim 18, wherein the deflector comprises at least one of an angled tube and a narrowing tube.

28. The hand-held vacuum device of claim 27, wherein the angle of the tube is about 10° or greater from horizontal.

29. The hand-held vacuum device of claim 18, wherein the vacuum connector is at least one of an oval-shaped o-ring and a suction cup-shaped vacuum connector.

30. The hand-held vacuum device of claim 18, wherein the expansion chamber is releasably connected to the housing by a quick release mechanism.

31. The hand-held vacuum device of claim 18, wherein the substantially continuous vacuum drawn by the piston pump through the expansion chamber is from about 10 to about 30 in. Hg.

32. The hand-held vacuum device of claim 18, wherein the piston pump generates a flow rate through the expansion chamber of about 0.25 to about 1.0 cfm.

33. A hand-held vacuum device for evacuating a container, the device comprising:

a housing to hold an electrical motor operable to drive a piston pump and a piston valve, the piston pump and the piston valve being configured to draw a substantially continuous vacuum during each complete cycle of the piston pump, wherein the piston pump comprises a motor gear attached to a drive shaft, a piston rigidly attached to an end of an oval rack gear having an exterior guide surface, an arm pivotally attached to the drive shaft and having a guide pin functionally engaged against the exterior guide surface, and a planetary gear carried by the arm and operatively coupling the motor gear to the oval rack gear, wherein the arm holds the planetary gear in engagement with the motor gear and the oval rack gear as the oval rack gear reciprocates;

an expansion chamber releasably connected to and in fluid communication with the housing and the piston pump, the expansion chamber having a deflector to alter a fluid pathway of a fluid before entering an interior volume of the expansion chamber; and a vacuum interface having a vacuum connecter in fluid communication with the expansion chamber and configured to releasably couple to a valve disposed on a container to form an airtight seal therewith, wherein the expansion chamber separates air and liquid from the fluid drawn into the interior volume of the expansion chamber, and collects the liquid therein.

34. The hand-held vacuum device of claim 33, wherein the vacuum interface has a slot to receive a guide member disposed on the container to align an aperture on the vacuum interface with the valve disposed on the container.

35. The hand-held vacuum device of claim 34, wherein the aperture is surrounded by an oval-shaped o-ring seal to form an airtight seal between the expansion chamber and a valve disposed on the container.

36. The hand-held vacuum device of claim 34, wherein the vacuum interface is configured to accept a side edge of a pouch and form the airtight seal with the valve on a pouch wall proximal to the side edge.

37. The hand-held vacuum device of claim 34, wherein the guide member is adapted to be a closure mechanism with a valve disposed in the closure mechanism.

38. The hand-held vacuum device of claim 34, wherein the guide member is adapted to be a closure mechanism with a valve disposed proximate to the closure mechanism.

39. The hand-held vacuum device of claim 33, wherein the expansion chamber includes a window to allow a user to monitor an amount of the liquid held within the expansion chamber.

40. The hand-held vacuum device of claim 33, wherein the housing further comprises a switch and a power cord attached thereto.

41. The hand-held vacuum device of claim 33, wherein the housing and the expansion chamber are configured so as to enable the vacuum device to be used in a hand-held mode and a hands-free mode.

42. The hand-held vacuum device of claim 33, wherein the deflector comprises at least one of an angled tube and a narrowing tube.

43. The hand-held vacuum device of claim 42, wherein the angle of the tube is about 10° or greater from horizontal.

44. The hand-held vacuum device of claim 33, wherein the vacuum connector is at least one of an oval-shaped o-ring and a suction cup-shaped vacuum connector.

45. The hand-held vacuum device of claim 33, wherein the expansion chamber is releasably connected to the housing by a quick release mechanism.

46. The hand-held vacuum device of claim 33, wherein the substantially continuous vacuum drawn by the piston pump through the expansion chamber is from about 10 to about 30 in. Hg.

47. The hand-held vacuum device of claim 33, wherein the piston pump generates a flow rate through the expansion chamber of about 0.25 to about 1.0 cfm.

* * * * *